US010480127B2

(12) United States Patent
Lahtonen

(10) Patent No.: US 10,480,127 B2
(45) Date of Patent: Nov. 19, 2019

(54) LUBRICANT APPLICATOR AND METHOD FOR LUBRICATING A BACKING DRUM AND APPARATUS

(71) Applicant: Kari O. Lahtonen, New Glarus, WI (US)

(72) Inventor: Kari O. Lahtonen, New Glarus, WI (US)

(73) Assignee: VALMET TECHNOLOGIES, INC., Espoo (FI)

( * ) Notice: Subject to any disclaimer, the term of this patent is extended or adjusted under 35 U.S.C. 154(b) by 232 days.

(21) Appl. No.: 15/527,689

(22) PCT Filed: Nov. 17, 2015

(86) PCT No.: PCT/FI2015/050796
§ 371 (c)(1),
(2) Date: May 17, 2017

(87) PCT Pub. No.: WO2016/079382
PCT Pub. Date: May 26, 2016

(65) Prior Publication Data

US 2018/0016748 A1 Jan. 18, 2018

Related U.S. Application Data

(60) Provisional application No. 62/081,229, filed on Nov. 18, 2014.

(51) Int. Cl.
*D21H 23/34* (2006.01)
*D21H 25/10* (2006.01)

(52) U.S. Cl.
CPC ..... *D21H 23/34* (2013.01); *D21H 25/10* (2013.01)

(58) Field of Classification Search
None
See application file for complete search history.

(56) References Cited

U.S. PATENT DOCUMENTS 4,738,877 A 4/1988 Krautzberger
5,782,977 A * 7/1998 Eriksson ..... B05C 11/04 118/119
6,022,591 A * 2/2000 Ueberschar ..... B05C 5/0283 118/325
6,132,807 A * 10/2000 Hess ..... D21H 23/78 118/126

OTHER PUBLICATIONS

International Search Report for PCT/FI2015/050796 dated Feb. 11, 2016.
Written Opinion of the International Searching Authority for PCT/FI2015/050796 dated Feb. 11, 2016.

* cited by examiner

*Primary Examiner* — Shamim Ahmed
*Assistant Examiner* — Bradford M Gates
(74) *Attorney, Agent, or Firm* — Stiennon & Stiennon

(57) ABSTRACT

An illustrative lubricant applicator includes a body comprising an inner surface defining a lumen, an outer surface, and a connector fluidly connected to the lumen. The connector is configured to receive a lubricating fluid and convey the lubricating fluid to the lumen. A plurality of openings connects the lumen to the outer surface of the body. The lubricant applicator is configured for connection to a coater blade at a position such that the plurality of openings are configured to deliver the lubricant to an edge region of paper and a backing drum during coating of the paper.

13 Claims, 16 Drawing Sheets

LUBRICANT APPLICATOR AND METHOD FOR LUBRICATING A BACKING DRUM AND APPARATUS

CROSS REFERENCES TO RELATED APPLICATIONS

This application is a US national phase of PCT/FI2015/050796 filed on Nov. 17, 2015 and claims priority on U.S. provisional application No. 62/081,229 filed on Nov. 18, 2014 both of which are incorporated herein by reference.

STATEMENT AS TO RIGHTS TO INVENTIONS MADE UNDER FEDERALLY SPONSORED RESEARCH AND DEVELOPMENT

Not applicable.

BACKGROUND OF THE INVENTION

Paper is commonly used throughout the world. Paper is commonly used for a variety of purposes. Paper can be used to package food. Paper can also be used as a medium for the written word, in applications such as books, newspapers, and magazines. Paper can be used to print documents using a computer. Paper is often used to track and document financial information, such as through financial statements, receipts, and bills. Paper may also be used to label a huge variety of products, containers, and any number of other things. Paper can even be made into art, such as through the practice of origami. As a result, the manufacture of paper is an important industry for all of these uses and more. High quality glossy paper may be used in documents such as magazines.

BRIEF DESCRIPTION OF THE INVENTION

An illustrative lubricant applicator includes a body comprising an inner surface defining a lumen, an outer surface, and a connector fluidly connected to the lumen. The connector is configured to receive a lubricating fluid and convey the lubricating fluid to the lumen. A plurality of openings connects the lumen to the outer surface of the body. The lubricant applicator is configured for connection to a coater blade at a position such that the plurality of openings are configured to deliver the lubricant to an edge region of paper and a backing drum during coating of the paper.

An illustrative method for lubricating a backing drum includes receiving lubricant at a lubricant applicator. The method also includes applying the lubricant to a first section of the backing drum. The lubricant is applied at a pressure configured to prevent a first section of a coater blade from coming into contact with the first section of the backing drum.

An illustrative apparatus includes a coater blade, a backing drum, and a lubricant applicator comprising a body with an inner surface defining a lumen, an outer surface, and a connector fluidly connected to the lumen. The connector is configured to receive a lubricating fluid and convey the lubricating fluid to the lumen. A plurality of openings connects the lumen to the outer surface of the body. The lubricant applicator is configured for connection to the coater blade at a position such that the plurality of openings are configured to deliver the lubricant to an edge region of paper and the backing drum during coating of the paper.

BRIEF DESCRIPTION OF THE DRAWINGS

Illustrative embodiments will hereafter be described with reference to the accompanying drawings.

DESCRIPTION OF THE PREFERRED EMBODIMENTS

Figure 1:
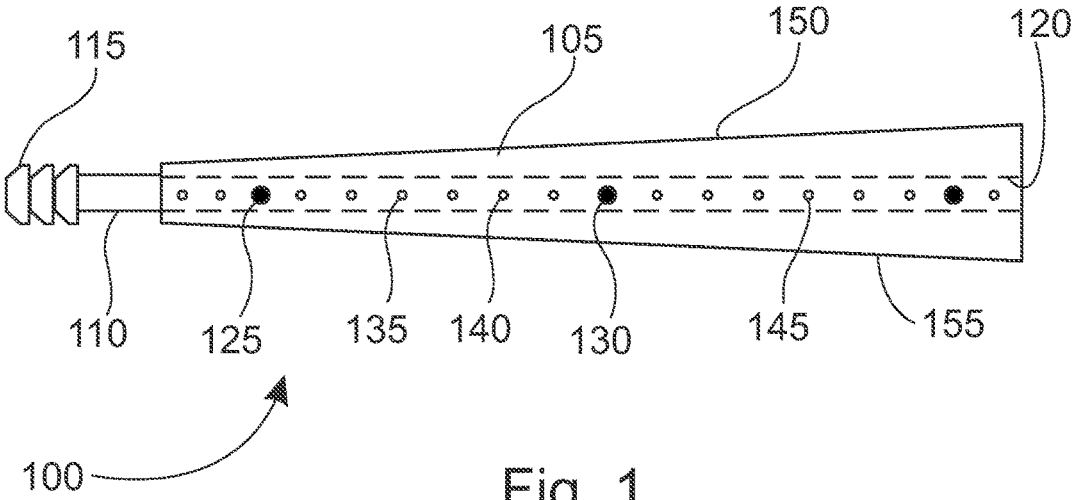
FIG. 1 is a representation of a front view of a lubricant applicator strip in accordance with an illustrative embodiment.

Described herein are illustrative embodiments for an apparatus, an article of manufacture, and methods for a coater blade lubricator. During the manufacturing of paper, for example high quality paper, coatings are often applied the paper to give the paper certain desirable traits or qualities. In such operations, the large rolls of paper are passed over large cylindrical drums (also called backing drums herein). While rotating on such drums, various processes, such as the applying of coatings, may be performed on the paper as it is moved through a manufacturing facility.

When the paper comes to a paper coating station, a coating is applied to the paper. After a coating is initially applied, a coater blade helps to spread the coating evenly onto the paper and remove any excess coating. The coater blade is oriented such that the coater blade presses against the paper, which is rotating on a backing drum. Thus, the paper is between the backing drum and the coater blade, allowing for pressure on the paper that is adequate to spread and remove excess coating. When a paper coating station is working properly, the pressure generated on the paper from the backing drum and the coater blade is adequate to spread the coating without breaking or damaging the paper.

Often during a coating process, the paper does not extend across the entire width of the backing drum. However, it is desirable to have a coater blade that extends wider than the width of the paper roll. By extending beyond the paper, the coater blade can more effectively spread the coating and remove excess coating. However, such a configuration may allow the coater blade to come into contact with the backing drum. It is possible for the coater blade to damage the backing drum as a result. Furthermore, over time the abrasion of continuous paper on a coater blade causes wear on the coater blade. As the coater blade wears where it has come into contact with the abrasive paper, the coater blade may not wear as much on the far edges of the blade where it only contacts a smooth backing drum. Accordingly, the blade may over time get shorter where the paper is located and remain longer where the backing drum is contacted by the coater blade. Because the coater blade must maintain appropriate pressure on the paper to properly complete the blade's spreading and removing of coating duties, this can cause increased damage on the backing drum as the coater blade ages. In other words, as the coater blade wears from the paper, the part of the coater blade not contacting the paper will create more and more pressure and contact with the backing drum, which can cause increased damage to the backing drum. If a backing drum is damaged in this way, it may not be suitable to process materials like paper that can be easily damaged.

In order to address this potential damage, coater blades can be changed as they wear in order to prevent significant damage to a backing drum. Another way to address this damage is resurfacing the surface of a damaged backing drum. However, illustrative embodiments as disclosed herein provide an apparatus, an article of manufacture, and methods for a coater blade lubricator that can prevent damage to a backing drum as a coater blade ages, or at least extend the time that a coater blade can be used before it must be replaced.

The embodiments disclosed herein can optimize lubrication of the backing drum and the coater blade in order to minimize friction between the backing drum surface and the coater blade tip at the ends, where the edge of the sheet of paper being processed is not covering the backing drum surface. In other words, it will decrease friction between the blade tip and the roll surface during paper coating. In some embodiments, the lubricant may be applied to a coater blade with a pressure and volume such that the coater blade does not contact the backing drum on the edges where there is no paper. In other words, the lubricant can essentially push the blade away from the surface of the backing drum, and the space created can be taken up by the lubricant.

In an illustrative embodiment, lubricant application devices can be attached to the ends of the coater blades. Advantageously, these devices can be attached to a coater blade when the blade is not installed in a paper coating station. This can help reduce downtime when a coater blade is changed because the lubricant applicator can be already attached to the blade before it is installed in the paper coating station.

Lubricant application as disclosed herein can also advantageously reduce temperatures locally at the tip of the coater blade and the surface of the backing drum. Another advantage of lubricating a coating process in this way is that the lubricant itself may help guide debris away from the paper and other important parts and functions of the paper coating station.

Other benefits to paper coating can be realized through the embodiments disclosed herein. Since the disclosed embodiments help prevent coater blade and backing drum wear, the life of coater blades and backing drums can be extended. Furthermore, operator safety can be improved. First, since parts will need to be replaced less often there are fewer chances of injury while replacing and moving parts. This is particularly true here where a coater blade may present laceration hazards and a large backing drum may present crushing hazards or potential pinch points. Furthermore, the embodiments disclosed herein prevent an operator from attempting to manually adjust or configure coating or lubricating devices.

In an illustrative embodiment, lubricant is spread by a lubricant application device directly into a blade nip. A blade nip generally refers to the area between a coater blade and the backing drum. Often, a coater blade is oriented to be at angle. In other words, an imaginary line extending from the blade in this embodiment would not pass through the center of a circular cross section of the backing drum. Accordingly, in such an embodiment, the blade nip may include a space between the coater blade and the backing drum that is a function of the angle of the coater blade relative to the backing drum.

In an illustrative embodiment, the lubricant application device is a lubricant applicator strip. Such a strip is capable of lubricating the full width of the blade nip where there is no paper on the surface of the backing drum. Additionally, the lubricant applicator strip may lubricate a portion of the surface of the paper that is passing around the backing drum. In this way, the lubricant applicator strip can effectively lubricate a portion of the backing drum at an edge region (i.e., where the edge of the paper is on the backing drum). Additionally, if the paper width changes, this can effectively lubricate the backing drum even if the edge region or edge of the paper changes location (because of a change in the paper width). Similarly, such a lubricant applicator strip can lubricate the backing drum if different paper rolls with different widths are used without needing to adjust the location of the lubricant applicator strip. The lubricant applicator strip may be formed out of many various materials, including metal, plastic, synthetic plastic, etc. The lubricant applicator strip can be attached to the coater blade with any appropriate attachment mechanism. For example, the attachment mechanism may include clamps, pressure, friction, screws, adhesives, etc.

The lubricant is then applied from the lubricant applicator strip. The lubricant can be applied with a pressure such that the lubricant pushes the tip of the coater blade away from the surface of the backing drum. Such pressure can create a constant film on the backing drum surface separating the backing drum surface and the tip of the coater blade. This can prevent contact and friction between the surface of the backing drum and the coater blade.

The lubricant applicator strip can further be designed and located on the coater blade such that excess lubricant can flow out toward the edge of the backing drum, which can further remove debris from the area. The lubricant applicator strip can further include a guiding wall (or lip) for the lubricant on the side of the applicator near the backing drum. The guiding wall can create a pressurized cavity for the lubricant between the lip, the coater blade, and the surface of the backing drum, which can help supply pressure to reduce friction or contact between the coater blade and the backing drum. Furthermore, the pressurized cavity can help reduce excess lubricant backflow. In other words, the pressurized cavity can cause a space to form between the coater blade and the surface of the backing drum, either dramatically reducing friction between the coater blade and the backing drum, or even preventing the coater blade and the backing drum from contacting each other.

Any lubricant that has flowed away from the blade nip can be collected by the system. For example, the paper coating station can have an excess coating collection system. In one embodiment, the coating collection system may be used to collect the excess lubricant. If the lubricant is the same as the coating, the collected liquid can be reused in the system. In another embodiment, the system may have a separate collection system for the lubricant. In this embodiment, the lubricant may also be reused after being collected by the collection system.

FIG. 1 is a representation of a front view 100 of a lubricant applicator strip in accordance with an illustrative embodiment. In alternative embodiments, fewer, additional, and/or different components may be included. The front view 100 shows a first section 110 of a lubricant applicator strip and a second section 105 of a lubricant applicator strip. The first section 110 and the second section 105 make up what may be referred to as the body of the lubricant applicator strip.

The first section 110 includes a plurality of ridges 115. The ridges 115 allow for a connection to a hose, such as a rubber or plastic hose. Such a hose can stay attached based on compression and friction with the ridges 115. Advantageously, the ridges 115 also allow for quick set up when and if a coater blade needs to be changed. That is, it is not difficult or time consuming to attach a hose to the first section 110 with the ridges 115. The first section 110 is hollow such that lubricant can pass through it. In other words, the first section 110 includes an inner surface defining a lumen through which lubricant may pass. Additionally, the first section 110 has an opening or connector on the left hand side of FIG. 1, where a hose would connect, through which the lubricant may pass to enter the lubricant applicator strip. In an alternative embodiment, other methods may be used to attach a or otherwise get the lubricant to the lubricant applicator strip. For example, the hose may be attached with adhesive, some sort of clamp, etc. The hose could also be varied. For example, a more durable and rigid hose, such as a metal hose may be used. In another alternative embodiment, a hose may not be utilized to move the lubricant to a lubricant applicator. For example, if a lubricant applicator was more integrated in a paper coating station, the transportation methods may be more akin to a chamber that holds and transports lubricant as opposed to a hose.

The second section 105 of the lubricant applicator strip includes a top side 150 and a bottom side 155. Similarly, the front view 100 of FIG. 1 represents a front face of the lubricant applicator strip. Opposite of the front face, and not visible in this view is a back face. An edge of a top face is visible as the top side 150. Similarly, an edge of a bottom face is visible as the bottom side 155. The bottom face is generally orthogonal to the front face and the back face. Additionally, the top face is generally orthogonal to the front face and the back face. Accordingly, the front face and the back face are generally parallel, while the top face and the bottom face are also generally parallel. The top face and the bottom also generally extend from front face to the back face. The width of each face, as an example only, may be 0.5-1.5 cm (0.197-0.591 in).

The second section 105 of the lubricant applicator strip includes screws 125 and 130. Here only the end of the screws 125 and 130 are shown. The heads of the screws 125 and 130 are hidden. Although not shown here, the lubricant applicator strip could be attached to a coater blade on the back face. The screws 125 and 130 would then extend through the coater blade and the lubricant applicator strip to secure the lubricant applicator strip to the coater blade. The head of the screws 125 and 130 would therefore be on the opposite side of the coater blade than the lubricant applicator strip. In alternative embodiments, different attachment mechanisms may be utilized to attach the lubricant applicator strip to the coater blade.

The second section 105 further includes various openings 135, 140, and 145. Here, the openings 135, 140, and 145 are circular in shape. However, since the openings 135, 140, and 145 actually extend from the front face further into the second section, the openings 135, 140, and 145 are actually cylindrical in shape, thus a circular cross section. In alternative embodiments, the openings 135, 140, and 145 may have different cross sectional shapes than a circle. For example, the cross section may be square shaped, triangle shaped, polygon shaped, or some other shape entirely. In another example, the openings 135, 140, and 145 may still have a circular cross section, but may actually be conical in shape. This shape could be used as a nozzle to increase or decrease pressure of the lubricant being sprayed onto the coater blade and/or the backing drum. Further, in this embodiment, the screws 125 and 130 are currently using openings that were (before they had screws in them) similar to the openings 135, 140, and 145 as shown. In other words, if another attachment mechanism is utilized, the lubricant applicator strip may include additional openings than those shown here. Further, less or more openings than those openings shown in FIG. 1 may exist in alternative embodiments.

Also in the second section 105 is an inner surface that defines a lumen 120. The lumen 120 and the lumen in the first section 110 may be considered the same lumen, as they are connected. The lumen 120 is shown by a dotted line in FIG. 1. The lumen 120 is a space where the lubricant can flow from the first section 110 into the second section 105 and out onto the backing drum through the openings 135, 140, and 145, for example. As such, the openings 135, 140, and 145 are connected to the lumen 120. The openings 135, 140, and 145 connect the lumen 120 to an outer surface of the body of the lubricant applicator strip. In other embodiments, other configurations may be devised to transport and distribute lubricant on the coater blade and the backing drum surface.

In the present embodiment, an opening such as the opening 130, is approximately 1.5 mm (0.0591 in) in width. In different embodiments, the openings may be another size, such as approximately 0.5-3.0 mm (0.0197-0.118 in) in width. In the present embodiment, the space between openings is approximately 1.0 cm (0.394 in). The space between openings may be other distances as well, such as approximately 0.5-1.5 cm (0.197-0.591 in). In the present embodiment, the first section 110 is approximately 1.8 cm (0.709 in). In other embodiments, the section 110 may be other lengths, such as, by way of example only, 1.0-3.0 cm (0.394-1.181 in). In the present embodiment, the second section 105 is approximately 17.6 cm (6.93 in) in length. In other embodiments, the section 105 may be other lengths, such as 10-30 cm (3.94-11.81 in). None of the dimensions disclosed herein are meant to be limiting. Instead, the dimensions are disclosed merely to demonstrate possible embodiments of the system.

The lubricant applicator strip is narrower on the left side of FIG. 1 than on the right side of FIG. 1. The change in dimension corresponds to a guiding wall (or lip) that extends further as one moves further to the right of the strip. The guiding wall is discussed in greater detail herein. The guiding wall (or lip) may be different heights to move lubrication flow away from an edge of the paper (i.e., the edge region; the edge region can define an area at the edge of the paper and areas of the paper and backing drum that are close to the actual edge of the paper). In other words, the lubricant can flow toward the edge of the backing drum. Advantageously, this may help remove debris from the area, including the area of the paper edge or edge region. Furthermore, a higher guiding wall near the paper edge or edge region may help maintain a higher pressure at the area with the paper edge or edge region, helping to decrease friction on the blade and the backing drum in the area of the paper edge or edge region. In an alternative embodiment, but to achieve some of the same results, a lubricant applicator strip may be installed at an angle, such that the strip is relatively close to the paper edge or edge region but is farther from the backing drum toward the edge of the backing drum. In further additional embodiments, a guiding wall or lip may be curved so that lubricant returning from the blade and blade nip may be easily returned or recirculated toward the blade and blade nip. This may further cause increased pressure in a pressure cavity created by the lubricant. Examples of a curved guiding wall or lip is demonstrated at least in FIGS. 16-18, discussed below. Further, use of a guiding wall or lip may result in less total lubricant flow usage because lubricant can be recirculated rather than consistently utilizing new lubricant flow.

In another illustrative embodiment, a lubricant applicator strip may be used without applying any additional lubricant to the backing drum, paper, or coater blade. In this embodiment, the lubricant applicator strip may simply not be connected to a lubricant supply, or the lubricant applicator strip may be designed specifically not to receive a lubricant supply but may be otherwise shaped like lubricant applicator strips as disclosed herein. In this embodiment, coating or lubricant that is already on the paper and/or backing drum can still be recirculated with a guiding wall or lip as disclosed herein to provide lubricant and/or a pressurized cavity at the coater blade, reducing the friction between the coater blade, paper, and backing drum.

Figure 2:
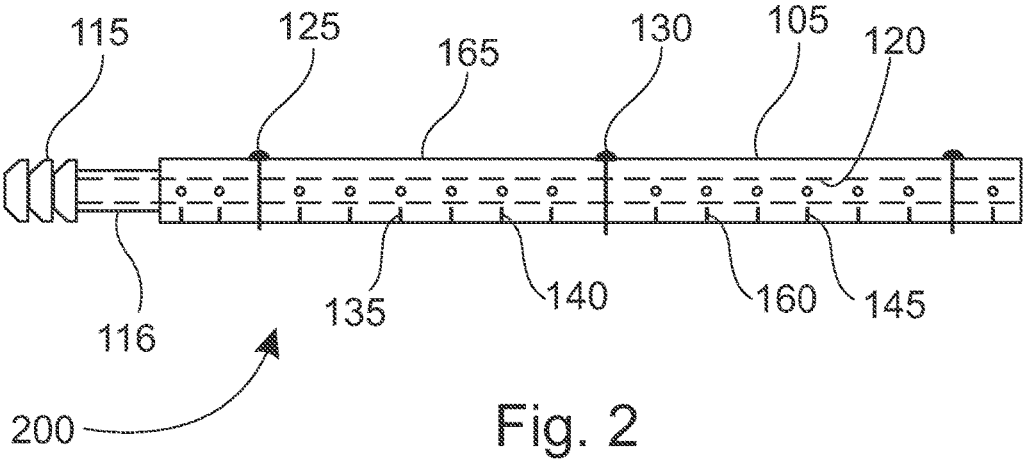
FIG. 2 is a representation of a top view of a lubricant applicator strip in accordance with an illustrative embodiment.

FIG. 2 is a representation of a top view 200 of a lubricant applicator strip in accordance with an illustrative embodiment. In alternative embodiments, fewer, additional, and/or different components may be included. The top view 200 shows similar elements of the lubricant applicator strip shown in FIG. 1 but a different view. For example, the ridges 115, first section 110, screws 125 and 130, lumen 120, openings 135, 140, and 145 are all shown. Note that the heads of the screws 125 and 130 are now visible. As noted above, if the lubricant applicator strip was connected to a coater blade, the coater blade would be located between the heads of screws 125 and 130 and the lubricant applicator strip itself.

Also shown in FIG. 2 is a back side 165 and a front side 160. The back side 165 shows a single edge of the back face of the lubricant applicator strip. The front side 160 shows a single of the front face of the lubricant applicator strip. With the top view 200, it is easily recognizable how the openings 135, 140, and 145 extend into the lumen 120. In this embodiment, the openings 135, 140, and 145 open out on the front face, which is a surface of the body of lubricant applicator strip. However, in alternative embodiments there may be openings that open out onto some or all of the back face, top face, or bottom face. Openings could also open out at the corner of multiple faces, or where curved surfaces are on the outside of the lubricant applicator strip, the openings may open out at a curved surface of the lubricant applicator strip. The top view 200 shows the top face. The guiding wall is not shown here, although the guiding wall is present on the top face of the lubricant applicator strip.

Figure 3:
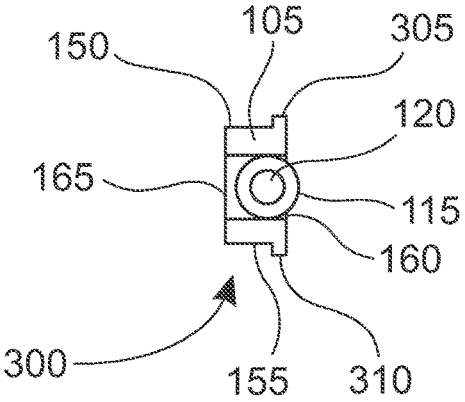
FIG. 3 is a representation of a left view of a lubricant applicator strip in accordance with an illustrative embodiment.

FIG. 3 is a representation of a left view 300 of a lubricant applicator strip in accordance with an illustrative embodiment. In alternative embodiments, fewer, additional, and/or different components may be included. The left view 300 shows the top side 150, the bottom side 155, the front side 160, and the back side 165. Also visible is the lumen 120 where the lubricant can pass through the first section 110 and the section 105. One of the ridges 115 is also visible in the left view 300. Both the openings 135, 140, and 145 as well as the screws 125 and 130 are not shown in this view for clarity.

The left view 300 also shows the guiding wall 305 and the guiding wall 310. When attached to a coater blade, one guiding wall will be closest to where a coater blade tip and backing drum would meet (and thus only one guiding wall might be used for creating a pressurized cavity that reduces the friction between the coater blade and backing drum). However, the second guiding wall may still be included on the lubricant applicator strip. In this way, the lubricator applicator strip may be used on either end of a coater blade (one would not utilize specially configured lubricant applicator strips for each end of a coater blade). However, in an alternative embodiment, the lubricant applicator strip may have only one guiding wall, such as the guiding wall 305. In another alternative embodiment, a lubricant applicator strip may have no guiding walls.

The guiding wall 305 extends from the top face of the lubricant applicator strip 105. The guiding wall 310 extends from the bottom face of the lubricant applicator strip 105. As shown in FIG. 3, the guiding walls 305 and 310 are oriented to be substantially flush with the front face of the lubricant applicator strip 105 but not the back face. The guiding walls 305 and 310 may extend, by way of example only, from the top face and bottom face, respectively, approximately 0.1-1.5 mm (0.0039-0.0591 in)

Figure 4:
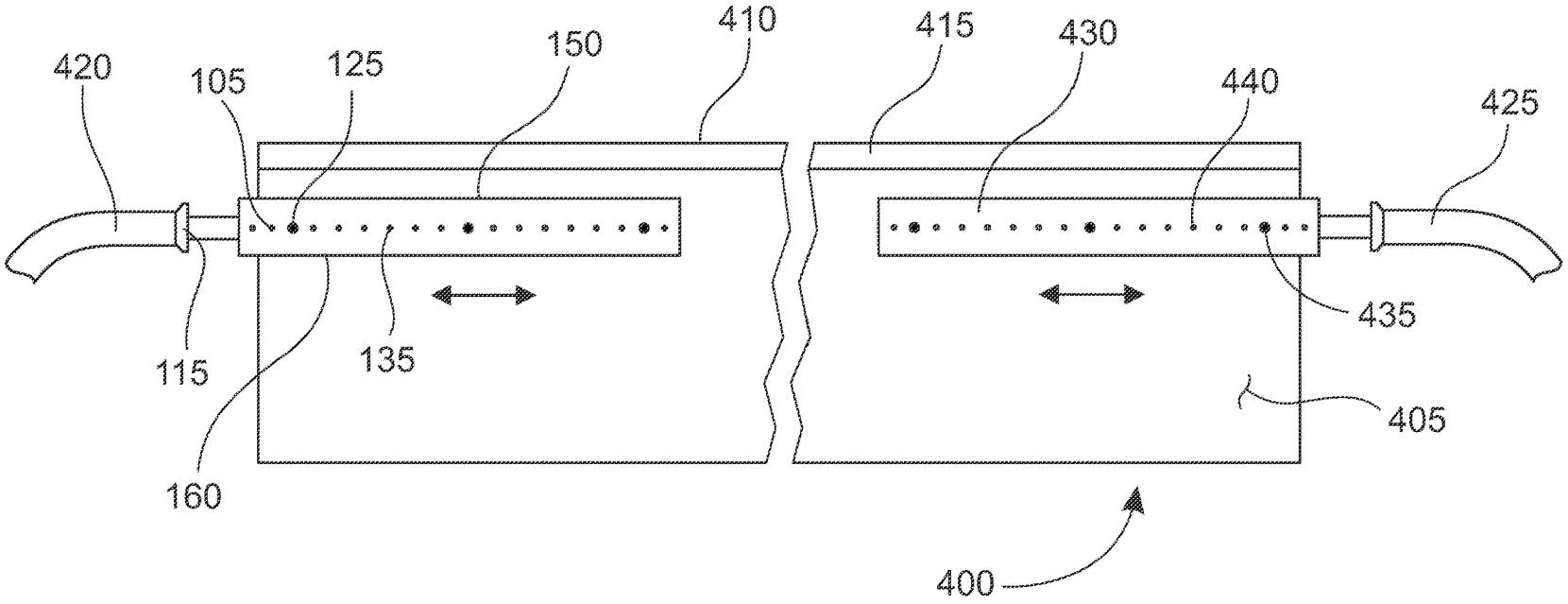
FIG. 4 is a representation of lubricant applicator strips attached to a coater blade in accordance with an illustrative embodiment.

FIG. 4 is a representation 400 of lubricant applicator strips 105 and 430 attached to a coater blade 405 in accordance with an illustrative embodiment. In alternative embodiments, fewer, additional, and/or different components may be included. The lubricant applicator strips 105 and 430 are examples of the lubricant applicator strip 105 shown in FIGS. 1-3. However, in other alternative embodiments, other versions of a lubricant applicator strip may be used.

FIG. 4 shows the coater blade 405. The coater blade 405 has a tip 410. The tip 410 is a different material than the coater blade 405. In an alternative embodiment, the tip 410 may be the same material as the coater blade 405. Here, the tip 410 of the coater blade 405 is a material 415 that may reduce friction between the blade tip 410 and the paper and/or the backing drum. The material 415 of the tip 410 may also deteriorate slower, allowing for longer blade life. The material 415 of the tip 410 may also be better for performing its functions of spreading coating and removing excess coating among the paper. The tip 410 may only cover the part of the coater blade 405 that comes into contact with the paper because the tip 410 may be more expensive or difficult to produce than the material of the coater blade 405. In an illustrative embodiment, the tip 410 contacts a backing drum and the paper on a backing drum (though not shown here in FIG. 4). The tip 410 of a coater blade 405 may also be beveled at different and/or multiple angles.

The coater blade 405 can be different sizes. For example, the coater blade 405 can be 0.508 mm (0.02 in) thick, 82.55 mm (3.25 in) wide, and 7.640 m (300.8 in) long. In other embodiments, other sizes of coater blades may be used. The size of the coater blade may depend on the desired functionality of the blade and the coater machine used in the process of coating the paper.

The lubricant applicator strip 105 includes the top side 150, the bottom side 160, the ridges 115, the screw 125, and the opening 135 are shown in FIG. 4. The lubricant applicator strip 430 is also shown with a screw 435 and an opening 440. The lubricant applicator strips 105 and 430 may both be similar to the lubricant applicator strip shown in FIGS. 1-3, even though not all of the features of the lubricant applicator strip 105 in FIGS. 1-3 is specifically demonstrated in FIG. 4. Here, the lubricant applicator strips are oriented such that the back side (the side without a guiding wall) is contacting the surface of the coater blade 405. Accordingly, the front side with openings is facing away from the coater blade 405 and visible in FIG. 4.

The lubricant applicator strips 105 and 430 are attached to the coater blade 405 using the screws 125 and 435 (as well as other screws shown in FIG. 4 that do not have specific reference numerals). Here, three screws secure each of the lubricant applicator strips 105 and 430 to the coater blade 405. In alternative embodiments, different numbers of screws may be used and the screws may be used in different locations than shown in FIG. 4 to secure the lubricant applicator strips 105 and 430. In another alternative embodiment, the lubricant applicator strips 105 and 430 may be secured to the coater blade 405 using other mechanisms. Such mechanisms may include, but are not limited to, clamps, nuts and bolts, rivets, adhesives, welds/tacks, or other attachment mechanisms. In another alternative embodiment, the coater blade 405 and the lubricant applicator strips may be formed as part of the same process so that a separate attachment mechanism is not utilized. In another alternative embodiment, the coater blade 405 is has an attachment mechanism or part of an attachment mechanism. For example, the coater blade 405 may include a bracket or some other base that the lubricant applicator strips 105 and 430 fit into to help secure the lubricant applicator strips 105 and 430 to the coater blade 405.

The lubricant applicator strips 105 and 430 are placed toward the coating material 415 of the coater blade 405, but not actually covering the material 415 or the tip 410. In this way, the lubricant applicator strips 105 and 430 may be able to adequately spray the nip and the area where the tip 410 of the blade contacts paper and a backing drum. The lubricant applicator strips 105 and 430 may be placed, for example, about 2 cm (0.79 in) from the tip 410 of the coater blade 405. Additionally, a hose 420 is attached to the lubricant applicator strip 105 at the ridges 115. A hose 425 is attached to the lubricant applicator strip 430. In this way, lubricant can be pumped or otherwise passed through the hoses 420 and 425 into the lubricant applicator strips 105 and 430. The lubricant can then be sprayed out of the lubricant applicator strips 105 and 430 out of, for example, the openings 135 and 440. Here, the hose 420 is attached to the lubricant applicator strip 105 by pressure on the hose from the ridges 115. That is, the inner diameter of the hose 420 is slightly smaller than the largest diameter of the ridges 115. However, the hose 420 is somewhat flexible, allowing for adequate attachment to the lubricant applicator strip 105. The hose 425 is similarly attached. In other alternative embodiments, the hoses 420 and 425 may be attached in other ways. For example, the hoses may also be attached using clamps, adhesives, or some other attaching or sealing mechanism.

Figure 5:
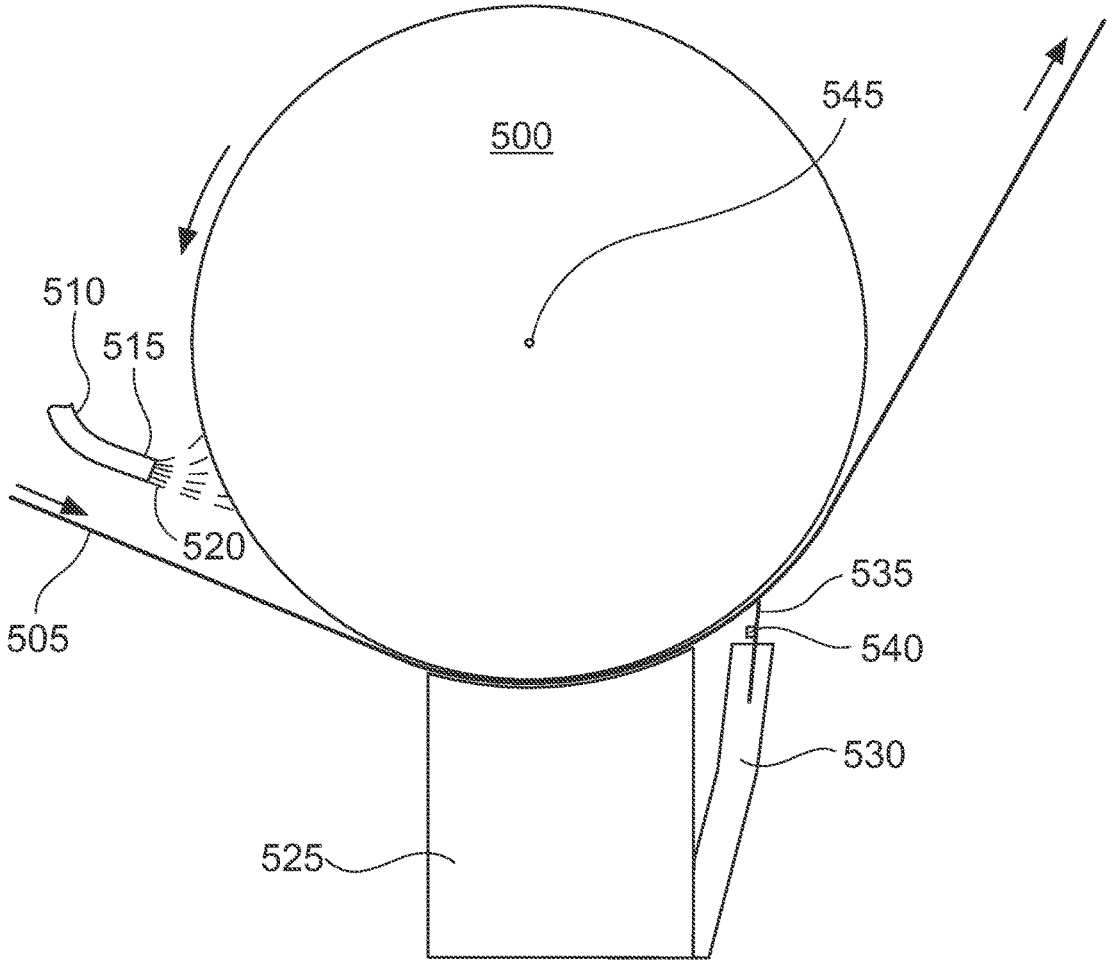
FIG. 5 is a representation of lubricant applicator strip used with a paper coating station in accordance with an illustrative embodiment.

FIG. 5 is a representation of lubricant applicator strip 540 used with a paper coating station in accordance with an illustrative embodiment. In alternative embodiments, fewer, additional, and/or different components may be included. FIG. 5 shows a backing drum 500, paper 505, and a coating applicator 525. The backing drum 500 rotates, and with it the paper 505 can rotate around an axis 545 of the backing drum 500. Here, as indicated by arrows, the paper is moving generally from left to right across FIG. 5. In other embodiments, the orientation of the paper coating station may be different. At the coating applicator 525, a coating is applied to the paper 505. Detail of the coating applicator 525 is not shown here, but the coating applicator 525 may have for example, a supply for the coating, an applicator for the coating, and an excess coating collection and recirculation system. In some embodiments, a lubricant used by the system and methods disclosed herein may be the same as the applied coating at the coating applicator 525. In other embodiments, the lubricant used by the system and methods disclosed herein may not be the same as the applied coating.

In an alternative embodiment, the coating may be applied to the paper 505 at a coater head 530 instead of or in addition to the coating being applied at the coating applicator 525. In this way, the coating may be applied to the paper closer to a coater blade 535.

FIG. 5 further shows the coater blade 535. The coater blade 535 is secured in place by the coater head 530 using pressure on the blade. An embodiment for securing a coater blade such as the coater blade 535 is discussed below with respect to FIG. 7. After coating has been applied by the coating applicator 525 or the coater head 530, the paper 505 passes between the backing drum 500 and the coater blade 535. As discussed herein, the coater blade 535 spreads the coating on the paper and removes excess coating from the paper. A lubricant applicator strip 540 is also attached to the coater blade. Although not visible in FIG. 5, another lubricant applicator strip is attached to the other end of the coater blade. In other words, the second lubricant applicator strip is hidden in the view of FIG. 5 by the lubricant applicator strip 540. The lubricant applicator strip 540 may be a lubricant applicator strip as discussed with respect to FIGS. 1-4 above. The lubricant applicator strip 540 applies lubricant to the area on the edge of the backing drum 500 and the paper 505 (i.e., the edge region) to lubricate between the coater blade 540, the paper 505, and the backing drum 500 as disclosed herein. A sprayer 510 may additionally provide a lubricant 520 to the backing drum 500 out of the nozzle 515.

Figure 6:
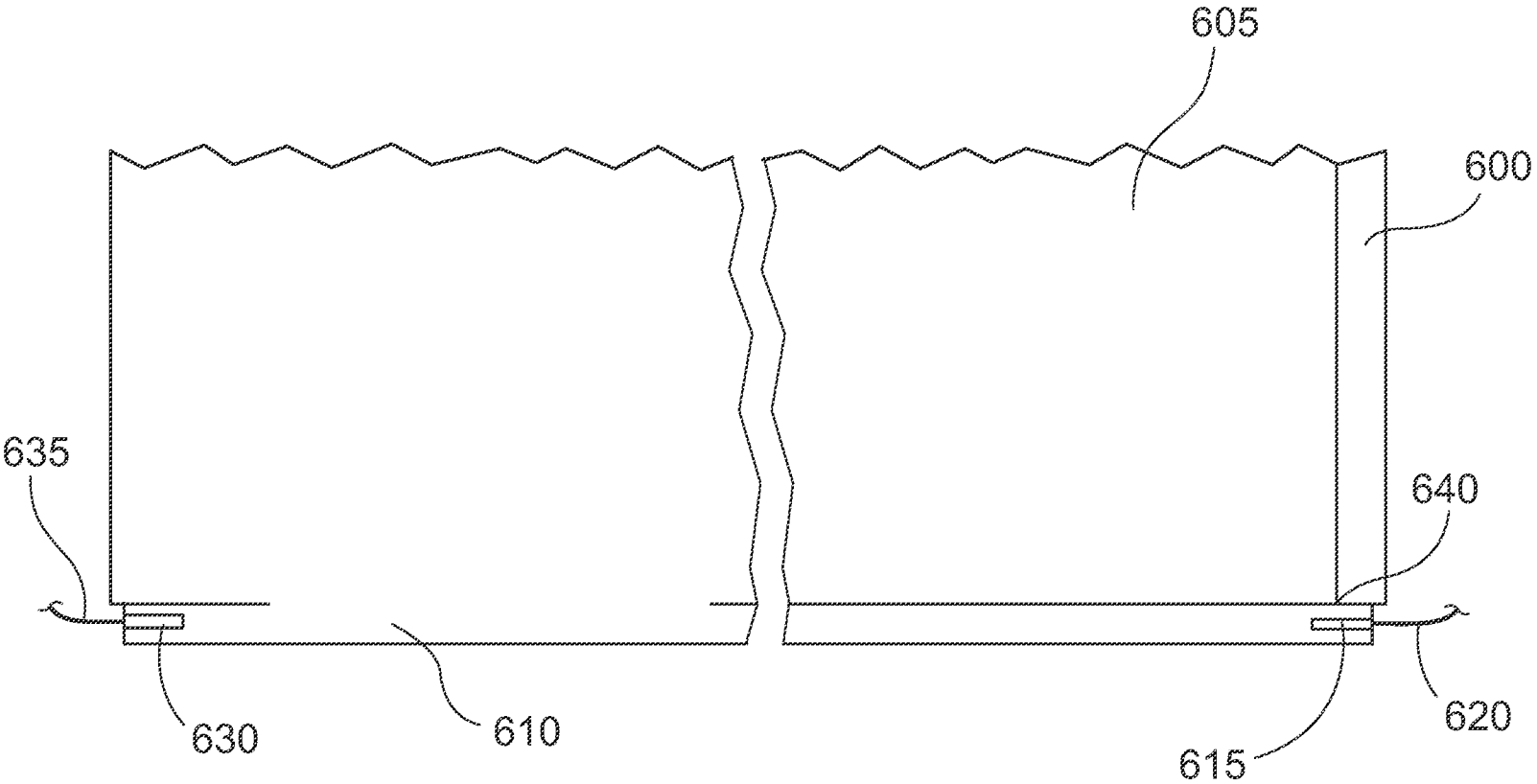
FIG. 6 is a representation of a lubricant applicator position relative to a backing drum of a paper coating station in accordance with an illustrative embodiment.

FIG. 6 is a representation of a lubricant applicator position relative to a backing drum 600 of a paper coating station in accordance with an illustrative embodiment. In alternative embodiments, fewer, additional, and/or different components may be included. The backing drum 600 rotates paper 605. A coater blade 610 spreads coating and removes excess coating from the paper 605 as it is moved past the coater blade 610.

Lubricant applicator strips 630 and 615 are located on the coater blade 610 as disclosed herein. Here, the lubricant applicator strips 630 and 615 are attached to hoses 635 and 620, respectively. As disclosed herein, the hoses 635 and 620 can transport lubricant to the lubricant applicator strips 630 and 615, so that the lubricant applicator strips 630 and 615 can apply the lubricant to the backing drum 600 and the paper 605. The lubricant is applied by spraying the lubricant in a nip between the coater blade 610 and the paper 605/backing drum 600. As disclosed herein, the pressure of the sprayed lubricant from the lubricant applicator strips 630 and 615 can keep the coater blade 610 from contacting the backing drum 600.

The lubricant applicator strips 630 and 615 are oriented so that surface area of the backing drum 600 that is not covered by the paper 605 is adequately lubricated as the backing drum 600 turns. Additionally, the lubricant applicator strips 630 and 615 also extend to a portion of the paper 605. In this way, the lubricant applicator strips 630 and 615 adequately lubricate an area, for example area 640, where the paper 605 terminates and the backing drum begins. The lubricant applicator strips 630 and 615 may also lubricate a portion of the paper 605 during operation.

Figure 7:
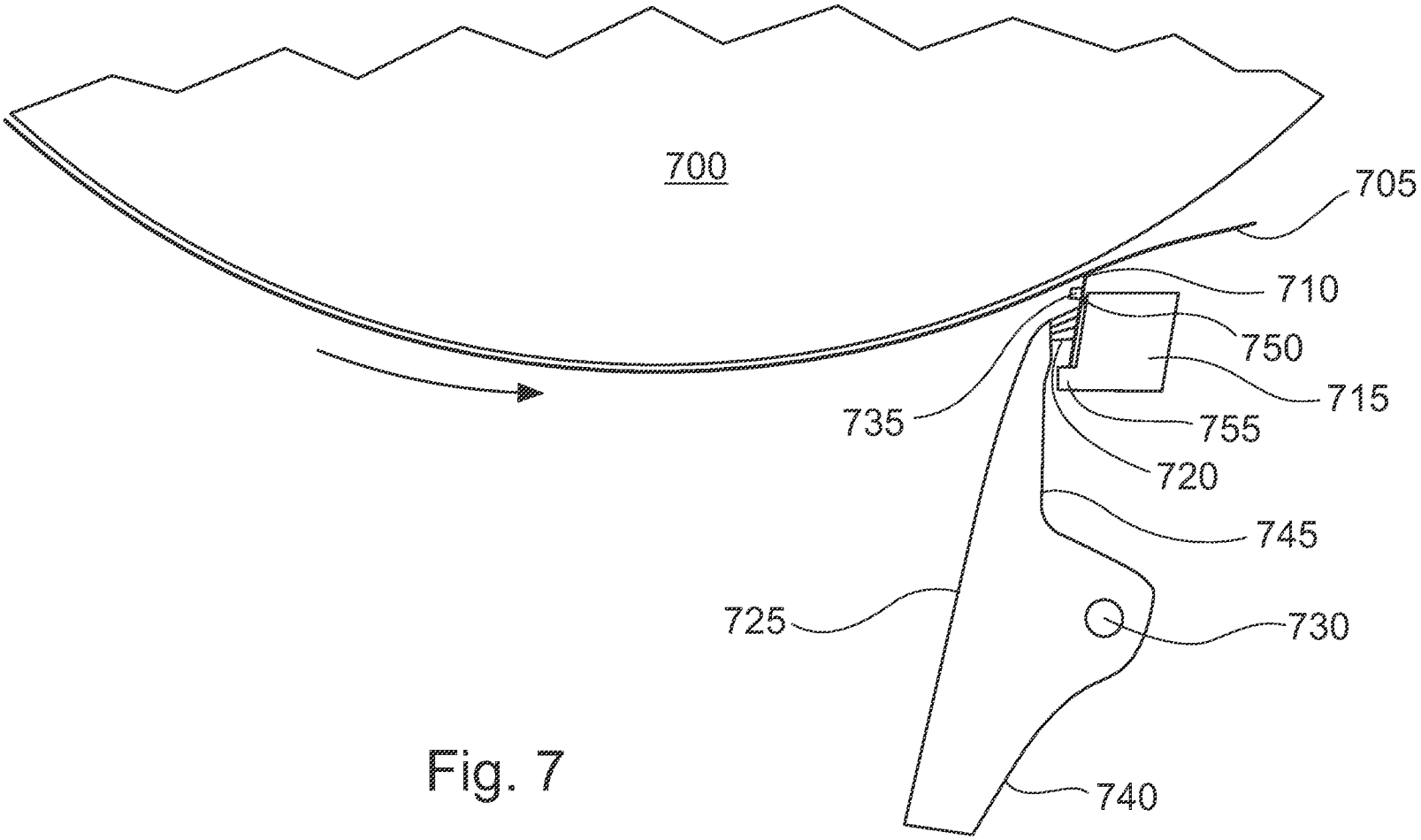
FIG. 7 is a representation of a close up view of a coater blade and lubricant applicator strip used with a paper coating station in accordance with an illustrative embodiment.

FIG. 7 is a representation of a close up view of a coater blade 710 and lubricant applicator strip 735 used with a paper coating station in accordance with an illustrative embodiment. In alternative embodiments, fewer, additional, and/or different components may be included.

FIG. 7 shows a backing drum 700 close up. The backing drum 700 rotates paper 705 around from left to right toward a coater blade 710. FIG. 7 also shows a blade clamp 725. The blade clamp 725 includes a hinge 730 around which the blade clamp 725 can rotate. The blade clamp 725 can rotate around the hinge 730 in various ways. For example, air tubes may run parallel to a length of the coater blade 710 and an axis of the backing drum 700. The air tubes may be oriented to contact different parts of the blade clamp 725 in order to make the blade clamp 725 move when the air tubes are inflated or deflated. For example, a first air tube may contact the blade clamp at a lower region 740 and a second air tube may contact the blade clamp at an upper region 745. The blade clamp 725 is shown in FIG. 7 in a closed position (i.e., the blade clamp 725 is clamped down on the coater blade 710). In such a configuration, the first air tube may be relatively inflated (i.e., the first air tube is inflated to push the lower region 740 such that the blade clamp 725 moves to actually clamp down the coater blade 710). In this configuration, the second air tube is relatively deflated, so that the upper region 745 can move toward the coater blade 710.

In order to open the blade clamp 725, the second air tube can be inflated to push the upper region 745. The first air tube can be deflated so that the lower region 740 can move in a way that opens the blade clamp 725. In alternative embodiments, the blade clamp 725 may move around the hinge 730 in other ways. For example, hydraulics or other mechanisms may control the movement of the blade clamp 725. In other embodiments, the blade clamp 725 may be manually adjusted.

The blade clamp 725 includes a blade clamp jaw 720 that clamps down on the coater blade 710 to hold it in place. On the other side of the coater blade 710, a blade holder 715 also helps secure the coater blade 710. The blade holder 715 includes a fulcrum 750, which contacts the coater blade. Additionally, a lip 755 may allow the coater blade 710 to rest on the lip 755 of the blade holder 715. The fulcrum 750 may be different mechanisms. For example, the fulcrum 750 may be a solid fulcrum bar that extends the length of the coater blade 710. In another example, the fulcrum 750 may be a third air tube. The air tube may be deflated while removing or loading the coater blade 710 and inflated to secure the coater blade in place after loading. An air tube in this configuration also provides for some calibration in how securely the coater blade 710 is held in place. The pressure with which air is filled into the air tube can impact how much give the air tube has, and consequently can impact the amount of pressure the coater blade 710 applies to the backing drum 700 and the paper 705. As a result, the air pressure in the air tube may be calibrated to allow the coater blade 710 to apply a proper amount of pressure for spreading coating on the paper 705 and removing excess coating, while not exerting excessive pressure on the coater blade 710 that could cause excessive wear on the coater blade 710 due to increased friction with the backing drum 700. In other alternative embodiments, other mechanisms may be used to hold a coater blade in place.

In one alternative embodiment, an air tube that acts as the fulcrum 750 may include multiple air tubes. For example, there may be three air tubes: one that spans a majority of the length of the coater blade 710 that is in between two shorter air tubes on each end of the coater blade 710. In this embodiment, the two air tubes on each end of the coater blade 710 can roughly correspond to the location of lubricant applicator strips on each end of the coater blade 710, such as the lubricant applicator strip 735 shown in FIG. 7. With a three air tube embodiment, the two air tubes on each end may be calibrated to have lower air pressure than the larger air tube in the middle. In this way, friction at the ends of the coater blade 710 may be reduced, while maintaining the necessary pressure on the paper with the larger air tube.

The lubricant applicator strip 735 is located on the coater blade 710 as disclosed herein. In an alternative embodiment, the lubricant applicator strip 735 may not be attached to the coater blade 710. For example, the lubricant applicator strip 735 may instead be attached to or incorporated in the blade clamp 725 or the blade holder 715. In another example, the lubricant applicator strip 735 may have its own support mechanism and may not be attached to any of the components shown in FIG. 7.

Figure 8:
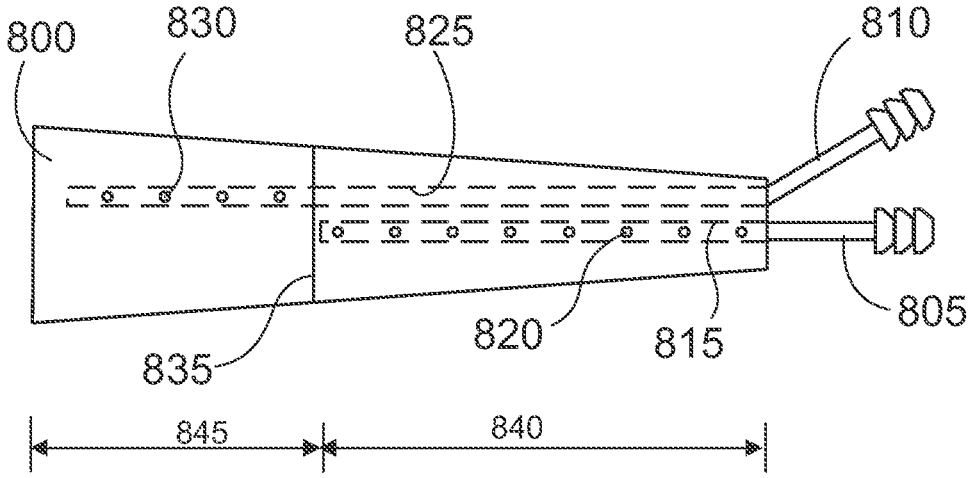
FIG. 8 is a representation of a lubricant applicator strip that can apply two types of lubricant in accordance with an illustrative embodiment.

FIG. 8 is a representation of a lubricant applicator strip 800 that can apply two types of lubricant in accordance with an illustrative embodiment. In alternative embodiments, fewer, additional, and/or different components may be included. The lubricant applicator strip 800 includes a hose connector 805 and a hose connector 810. The hose connectors 805 and 810 include ridges for connecting a hose. As disclosed above with respect to FIGS. 1-3, various embodiments may include different methods for connecting a lubricant applicator strip 800 to lubricant. Here, the method includes the hose connectors 805 and 810.

The hose connector 805 is connected to an inner surface that defines a first lumen 815. In other words, when a hose is connected to the hose connector 805, lubricant can flow through the hose connector 805 into the first lumen 815 of the lubricant applicator strip 800. The first lumen 815 is connected to several openings, including opening 820. The lubricant in the first lumen 815 can flow out through the openings. When the lubricant applicator strip 800 is used in various embodiments as disclosed herein, the lubricant that comes out of the openings flows into a nip between a coater blade and a backing drum, lubricating the two and decreasing wear on both the coater blade and the backing drum. In an illustrative embodiment, the lubricant can create a pressurized cavity between the coater blade and the backing drum.

The hose connector 810 is connected to an inner surface defining a second lumen 825. In other words, when a hose is connected to the hose connector 805, lubricant can flow through the hose connector 810 into the second lumen 825 of the lubricant applicator strip 800. The second lumen 825 is connected to several openings, including opening 830. The lubricant in the second lumen 825 can flow out through those openings. When the lubricant applicator strip 800 is used in various embodiments as disclosed herein, the lubricant that comes out of the openings flows into a nip between a coater blade, a backing drum, and paper rotating around the backing drum, lubricating the system and decreasing wear on both the coater blade and the backing drum. In an illustrative embodiment, the lubricant can create a pressurized cavity between the coater blade and the backing drum.

Advantageously, the embodiment shown in FIG. 8 allows for the use of multiple different lubricants in different locations. For example, a first lubricant can be used with the first hose connector 805 and the first lumen 815. Accordingly the first lubricant may be sprayed in a range 840. In an illustrative embodiment, the range 840 may be configured to correspond to an area where there is no paper on the backing drum. Accordingly, a lubricant that is more suited for coater blade and backing drum friction across a wide area may be sprayed in the range 840. Since the presence of paper can cause a pressure point on a coater blade a second lubricant more suited for that pressure point may be used with the second hose connector 810 and the second lumen 825. In this way, the second lubricant can be sprayed in a region 845. The lubricant sprayed in the region 845 may cover the location of the edge of the paper on the backing drum and the immediately surrounding areas of paper and the backing drum. In other words, the lubricant may cover the edge region.

Another advantage of the embodiment shown in FIG. 8 is that the pressure of each of the first and second lubricants (associated with the first and second regions 840 and 845) may be independently controlled by controlling the flow of the different lubricants into the hose connectors 805 and 810. For example, a higher pressure may be desired in the region 840 to create a more effective pressurized cavity to separate or reduce friction between the backing drum and the coater blade. A relatively lower pressure may be desired at the edge of the paper or edge region to ensure that the coater blade stays in contact with the paper so that coater blade can continue to spread coating and remove excess coating as it is supposed to. In an alternative embodiment, the system may apply a higher pressure in the region 845 relative to a lower pressure applied at the region 840.

The lubricant applicator strip 800 also includes an indicator strip 835. The indicator strip can indicate exactly where the openings associated with the region 840 end and the openings associated with the region 845 begin. The indicator strip 835 may be a bright color. The indicator strip 835 may go all the way around each surface of the lubricant applicator strip 800. The indicator strip 835 may be particularly helpful where an operator or computer with a visual sensor is attempting to adjust the lubricant applicator strip 800 to properly spray the first and second lubricants where desired. That is, the indicator strip 835 may be used to properly align the regions 840 and 845. In an alternative embodiment, the regions 840 and 845 (i.e., the areas where the first and second lubricant area sprayed) may overlap somewhat. Advantageously, the indicator strip 835 may be visible even if the lubricant applicator strip 800 is currently spraying lubricant.

Various lubricants may be used in the system. For example, latex lubricants, carboxymethyl cellulose (CMC) lubricants, starch lubricants, and/or calcium stearate lubricants may be used in various embodiments of the system and methods disclosed herein.

Figure 9:
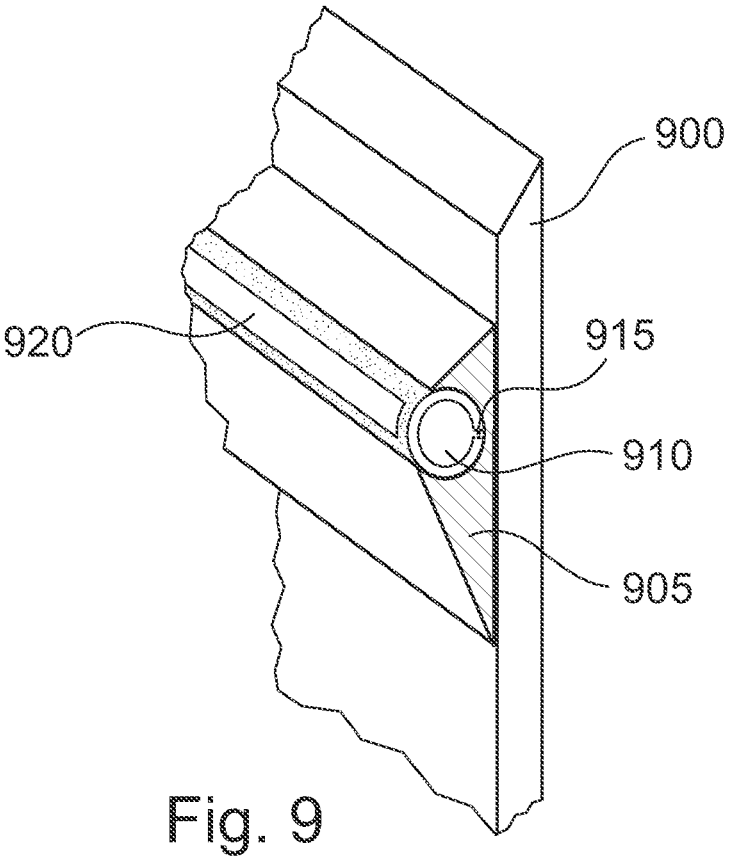
FIG. 9 is a representation of a bracket for securing a lubricant applicator strip in accordance with an illustrative embodiment.

FIG. 9 is a representation of a bracket 905 for securing a lubricant applicator strip in accordance with an illustrative embodiment. In alternative embodiments, fewer, additional, and/or different components may be included. FIG. 9 shows the bracket 905 attached to a coater blade 900. The bracket 905 may be attached to the coater blade 900 using a variety of methods, including, but not limited to, clamps, pressure, friction, screws, adhesives, etc.

The bracket 905 is designed to house a lubricant applicator strip. Such a lubricant applicator strip may be inserted into a receiving hole 910. The lubricant applicator strip would be shaped in order to fit into the receiving hole 910. Additionally, the receiving hole in FIG. 9 has a key slot 915. The lubricant applicator strip would be shaped to fit a portion into the key slot 915. This key slot 915 would keep the lubricant applicator strip from turning within the receiving hole 910. In other embodiments, the receiving hole 910 and the lubricant applicator strip may be different shapes, such as a triangle, rectangle, or any other shape. If the lubricant applicator strip is a certain shape, a key slot 915 may not be used. For example, if the lubricant applicator strip is shaped like a triangle, the receiving hole 910 could also be triangular, and the lubricant applicator strip could reside in the receiving hole 910 without turning. However, a key slot 915 or a non-equilateral triangular shape may still be used in order to ensure that the lubricant applicator strip is oriented properly within the receiving hole 910.

The bracket 905 also includes a window 920. The window allows for a lubricant applicator strip inserted into the bracket 905 to properly spray lubricant out of the openings of the lubricant applicator strip. The lubricant applicator strip may also be secured within the bracket 905 to ensure that the lubricant applicator strip does not slide out of the bracket 905. Additionally, the lubricant applicator strip may be adjusted laterally within the bracket 905, and secured at the desired position.

For example, a lubricant applicator strip similar to the lubricant applicator strip 800 shown in FIG. 8 may be used in combination with the bracket 905. Since this lubricant applicator strip 800 can spray two types of lubricant in two regions 840 and 845, the lubricant applicator strip 800 resting in the bracket 905 can be laterally adjusted to customize where the regions 840 and 845 will actually spray the two different lubricants onto paper and a backing drum.

The lubricant applicator strip can then be secured at the desired lateral location to align the spraying of the two lubricants as desired. This may be helpful if a roll of paper is uneven, then the lubricant applicator strip can be adjusted. In another example, this may be helpful if a plant is changing rolls that will be processed, and those rolls have different widths. In these examples, the lubricant applicator strip can be adjusted during the downtime, such as during the of changing rolls or could be adjusted real time while a coater station is operational. Furthermore, if a lubricant applicator strip has an indicator strip such as the indicator strip 835 as shown in FIG. 8, such an indicator strip may be visible through the window 920. This may facilitate easier calibration and alignment of the lubricant applicator strip within the bracket 905.

Figure 15:
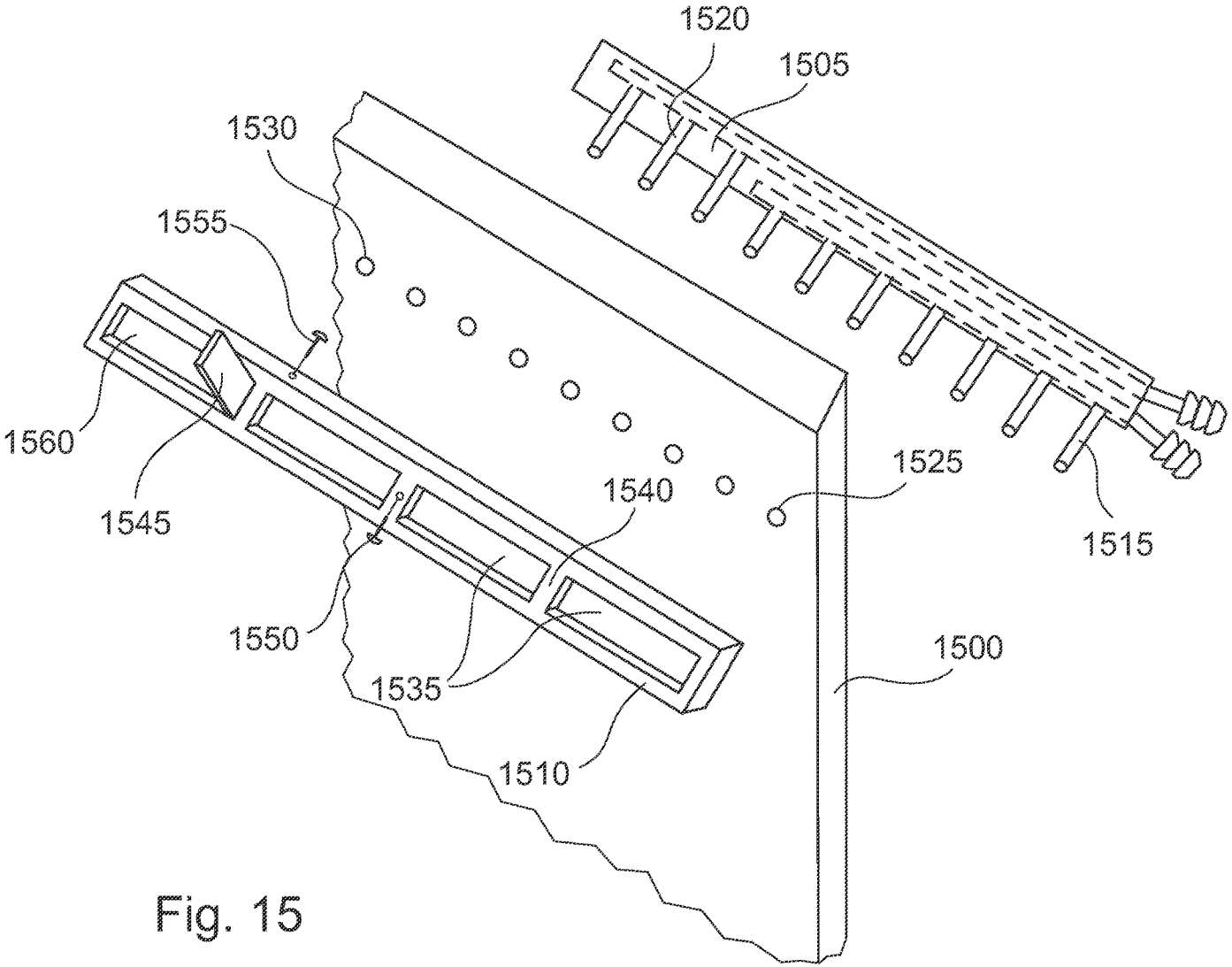
FIG. 15 is a representation of a lubricant applicator strip that extends through a coater blade in accordance with an illustrative embodiment.

FIG. 15 is a representation of a lubricant applicator strip 1505 that extends through a coater blade in accordance with an illustrative embodiment. In alternative embodiments, fewer, additional, and/or different components may be included. FIG. 15 includes a lubricant applicator strip 1505, a coater blade 1500, and a sliding attachment 1510. In this embodiment, the lubricant applicator strip 1505 is located on an opposite side of the coater blade 1500 than in other embodiments disclosed herein.

The lubricant applicator strip 1505 may be a lubricant applicator strip similar to the one shown in FIG. 8 and described above, except that the openings of the lubricant applicator strip 1505 extend out beyond the front face of the lubricant applicator strip 1505. For example, nozzles 1520 and 1515 are extensions of openings on the front face of the lubricant applicator strip 1505. In this way, the nozzles 1520 and 1515 can pass through perforations, such as hole 1530 and hole 1525, in the coater blade. The nozzles of the lubricant applicator strip 1505 can then adequately spray the blade nip and create a pressurized cavity between the coater blade 1500 and a backing drum as disclosed herein. Furthermore, the perforations may lower the pressure applied to the backing drum by the coater blade 1500 as further discussed below with respect to FIG. 14. In alternative embodiments, the coater blade 1500 may have even more perforations than the perforations used for the nozzles of the lubricant applicator strip 1505.

The lubricant applicator strip 1505 may attach to the coater blade in a variety of ways. For example, the lubricant applicator strip may be attached using clamps, pressure, friction, screws, adhesives, or other attachment mechanisms. For example, the lubricant applicator strip 1505 may be clamped together with the sliding attachment 1510. In another example, the nozzles of the lubricant applicator strip 1505 may be sized such that the outside diameter of the nozzles are slightly larger than the inside diameter of the perforations in the coater blade 1500. In this way, inserting the nozzles into the perforations of the coater blade 1500 may cause significant pressure to significantly attach the lubricant applicator strip 1505. In another example, pressure may be generated between a crossbar 1540 of the sliding attachment 1510, such that the pressure holds the sliding attachment 1510 and the lubricant applicator strip 1505 together around the coater blade 1500. In an alternative embodiment, the sliding attachment may not have any crossbars to generate pressure with the nozzles. In another alternative embodiment, the nozzles may not protrude from the surface of the coater blade 1500 significantly so that a crossbar of the sliding attachment 1510 would not contact a nozzle. In another example of how the lubricant applicator strip 1505 may be attached to the coater blade, the lubricant applicator strip 1505 may be attached using screws, nuts and bolts, rivets, adhesives, welds/tacks, or other attachment mechanisms. Such attachment mechanisms, such as a screw 1550, may also be used to attach the sliding attachment to the coater blade 1500. In one embodiment, screws, for example screw 1550, may be long enough to extend through the sliding mechanism 1510, the coater blade 1500, and the lubricant applicator strip 1505 in order to secure each one of them together.

In another illustrative embodiment, screws, such as screw 1555 may be used in a set screw type arrangement. In this arrangement, screws in the sliding mechanism 1510 can, when the three pieces shown in FIG. 15 are assembled, be tightened down on nozzles that extend through the coater blade and into the spaces of the sliding mechanism 1510, such as spaces 1535 and 1560, as examples. In this embodiment, the sliding mechanism may be easily moved, or slid, around on the surface of the coater blade 1500 because an operator may loosen any set screws and then move the sliding mechanism 1510.

The sliding mechanism 1510 may be moved to direct the angled portion 1545 over particular nozzles, such as the nozzle 1520. Here, only the spray from the nozzles associated with a second lubricant from the lubricant applicator strip 1505 can be affected by the angled portion 1545. In other embodiments, the angled portion may be directed to affect the spray of other lubricants and/or nozzles.

By adjusting the angled portion 1545 over the nozzle 1520 and/or other nozzles within the space 1560, a user or controller may adjust exactly where the lubricant from the nozzle(s) is being sprayed. This is advantageous because different paper rolls may vary in width, either between rolls or within rolls. For example, the sliding mechanism 1510 may be adjusted to accommodate rolls that are different in width by 2.54 cm (1.0 in). Other differences in paper roll widths may include 1.27 cm (0.5 in), 3.81 cm (1.5 in), 5.08 cm (2.0 in), 6.35 cm (2.5 in), or other dimensions. Being able to direct lubricant is advantageous because the area were the paper roll terminates wears the coater blade 1500 faster because of added friction at that point. By being able to target lubricant flow by adjusting the sliding mechanism 1510 and the angled portion 1545, the friction at the paper edge or edge region, tip of the coater blade, and backing drum can be reduced, thereby offering advantages in coater blade and backing drum wear.

Figure 10:
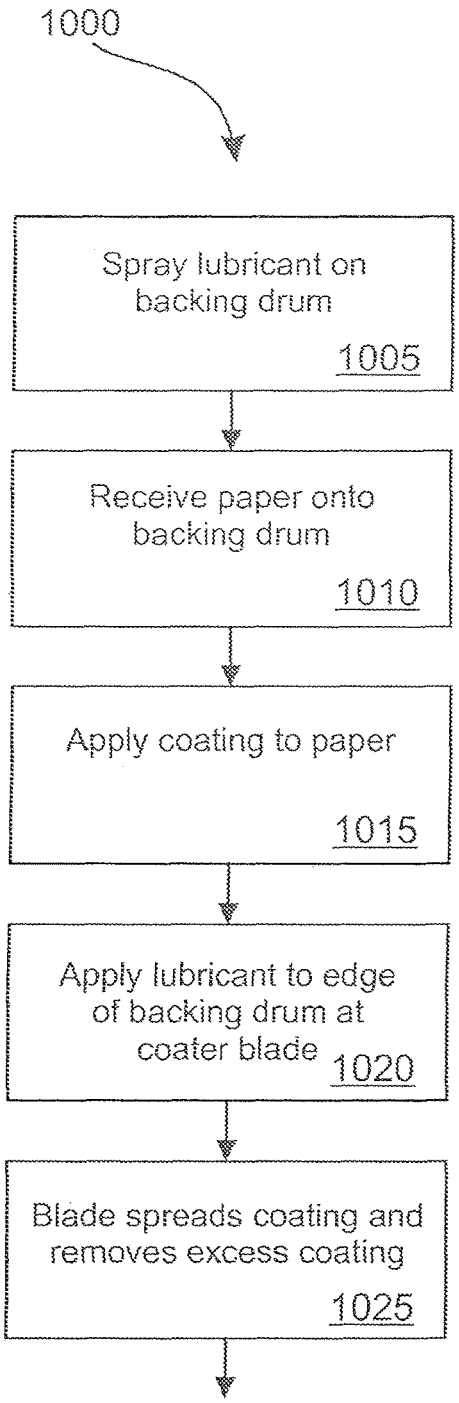
FIG. 10 is a flow diagram illustrating a method of applying lubricant to a backing drum in accordance with an illustrative embodiment.

FIG. 10 is a flow diagram illustrating a method 1000 of applying lubricant to a backing drum in accordance with an illustrative embodiment. In alternative embodiments, fewer, additional and/or different operations may be performed. Also, the use of a flow diagram is not meant to be limiting with respect to the order of operations performed. In an operation 1005, lubricant is sprayed onto a location on a backing drum. This lubricant is sprayed on the location before paper is applied to the location of the backing drum to lubricate the backing drum.

In an operation 1010, as the backing drum is rotated, paper is received onto the location of the backing drum. As the backing drum rotates, the received paper is rotated along with the backing drum. That is, the location of the backing drum and the paper move together during after the operation 1010. In an operation 1015, a coating is applied to the paper that is rotating with the drum. The coating is applied to the side of the paper not in contact with the backing drum.

In an operation 1020, lubricant is applied to the edge of the backing drum at the edge of a coater blade. Since the paper may not cover the entire surface of the backing drum, lubricant is applied to the portion of the backing drum that is exposed (i.e., does not have paper covering it). The lubrication is applied at or near the coater blade. The lubrication may be applied using any of the embodiments disclosed herein. As disclosed herein, the lubrication of the coating blade and the backing drum helps prevent wear on the coating blade and the backing drum. The lubrication can also create a pressurized cavity that keeps lubrication between the tip of the coating blade and the backing drum continuously during operation. In an operation 1025, the coater blade spreads the coating on the paper and removes excess coating from the paper as the backing drum continues to rotate the paper.

Figure 11:
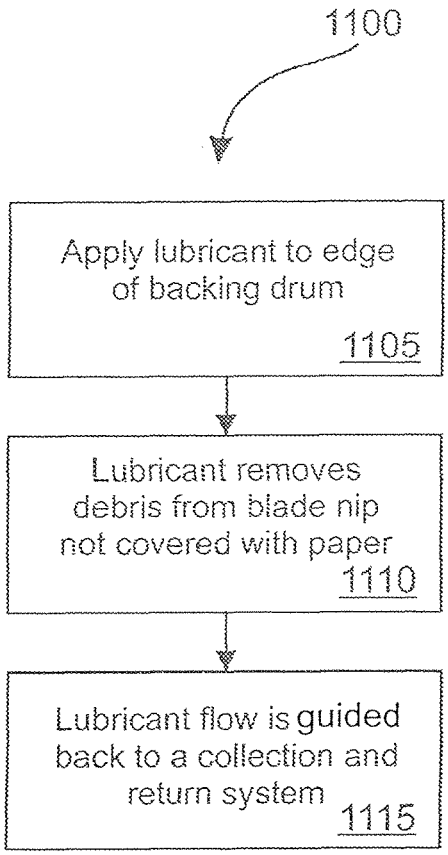
FIG. 11 is a flow diagram illustrating a method lubricating and collecting lubricant in accordance with an illustrative embodiment.

FIG. 11 is a flow diagram illustrating a method 1100 lubricating and collecting lubricant in accordance with an illustrative embodiment. In alternative embodiments, fewer, additional, and/or different operations may be performed. Also, the use of a flow diagram is not meant to be limiting with respect to the order of operations performed. In an operation 1105, lubricant is applied to the edge of the backing drum at the edge of a coater blade. Since the paper may not cover the entire surface of the backing drum, lubricant is applied to the portion of the backing drum that is exposed (i.e., does not have paper covering it). The lubrication is applied at or near the coater blade. The lubrication may be applied using any of the embodiments disclosed herein.

In an operation 1110, the lubricant also removes debris from the blade nip (area between the coater blade and the backing drum) where the backing drum is not covered with paper. Removing debris can make the coating process work more smoothly and prevent downtime. For example, keeping the blade nip free of debris can help prevent the blade from wearing faster, can help prevent breaks in the paper roll, prevent down time for cleaning, and/or prevent an operator from trying to clear debris during operation of a coating station.

In an operation 1115, the lubricant is guided to a collection and return system. In this embodiment, the lubricant can be collected and reused by the system to prevent waste. In one illustrative embodiment, the lubricant may be the same fluid as the coating applied by the coating station. If so, a coating collection and return system may also collect the lubricant. The coating and lubricant collected from the process can then be reused as coating and/or lubricant without discrimination. If the lubricant applied is different than the coating, there may be separate collection and return systems for each of the coating and the lubricant. In an alternative embodiment, the lubricant may be different from the coating and both the lubricant and the coating may be collected by the same system. However, a return system may not be used, or the collected combined liquid may be processed before returning it for use as coating and/or lubricant.

Figure 12:
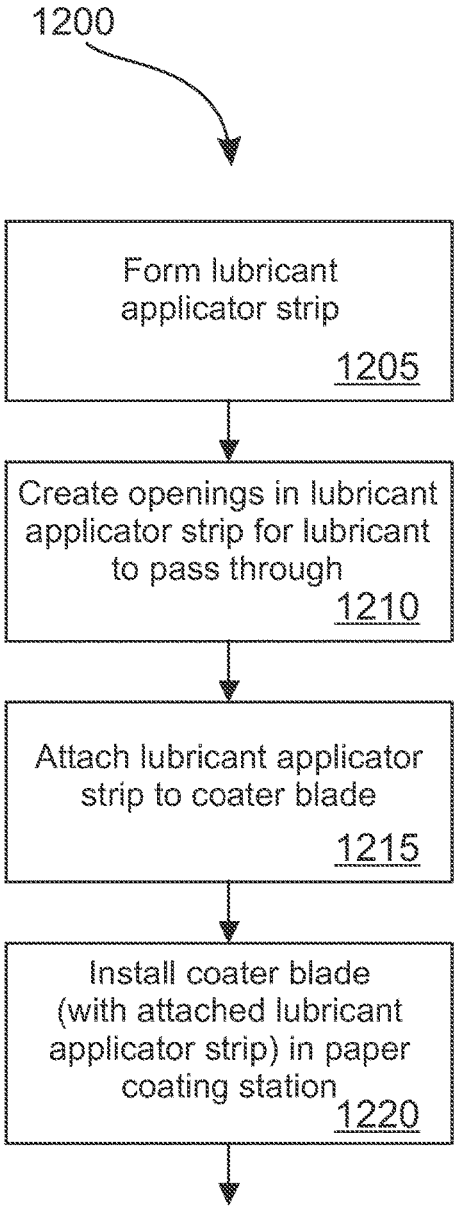
FIG. 12 is a flow diagram illustrating a method of manufacturing a lubricant applicator strip in accordance with an illustrative embodiment.

FIG. 12 is a flow diagram illustrating a method 1200 of manufacturing a lubricant applicator strip in accordance with an illustrative embodiment. In alternative embodiments, fewer, additional, and/or different operations may be performed. Also, the use of a flow diagram is not meant to be limiting with respect to the order of operations performed. In an operation 1205, a lubricant applicator strip is formed. For example, the lubricant applicator strip may be formed out of plastic or other material. As just one illustrative example, the lubricant applicator strip may be formed out of Teflon™. The lubricant applicator strip may be formed with the lumen(s) or hollow space(s) already existing in the middle of the lubricant applicator strip, through which lubricant can pass. In an alternative embodiment, the lumen(s) or hollow space(s) in the lubricant applicator strip may not be formed originally, but could be machined out. In another alternative embodiment, a lubricant applicator strip may be pre-installed on a coater blade. That is, when an operator installs a coater blade in a coating machine, the lubricant applicator strip will already be attached to the coater blade. In an alternative embodiment, an operator may affix the lubricant applicator strip to a coater blade after the coater blade is installed in the coater machine. In embodiments where the lubricator is free standing or attached to another part of the coater machine than the coater blade, the lubricator may not be pre-installed on the coater blade. In any of these embodiments, the lubricator or lubricant applicator strip may be disposable. That is, the lubricant applicator strip may be disposed of whenever a blade is changed. This may occur particularly where an applicator strip is pre-installed on a coater blade. In this way, the operator of a coater machine may never have to attach or un-attach a lubricant applicator strip from a coater blade. The operator may, however, in some embodiments, attaché hoses to a lubricant applicator strip in order to move lubricant to the strip.

In an operation 1210, openings in the lubricant applicator strip are created that connect the lumen(s) or hollow space(s) of the lubricant applicator strip to outside of the lubricant applicator strip. In this way, the lubricant can pass through the lumen(s) or hollow space(s) and through the openings into a blade nip as disclosed herein. In an alternative embodiment, the openings may be originally formed with the lubricant applicator strip and may not be separately created, machined, or punched out as shown in the operation 1210.

In an operation 1215, the lubricant applicator strip is attached to a coater blade. The lubricant applicator strip can be attached to a coater blade before or after a coater blade is installed in a coating station. Installing the lubricant applicator strip before or concurrent with installing the coater blade in a coating station may be easier and reduce time spent installing the lubricant applicator strip. If the lubricant applicator strip is installed after the coater blade is completely installed, it may take more time or effort, and even may cause the coater blade to be partially uninstalled to install the lubricant applicator strip.

In an operation 1220, the coater blade with the attached lubricant applicator strip is installed in the paper coating station. The hoses or other mechanism for getting the lubricant to the lubricant applicator strip can also be attached.

Figure 13:
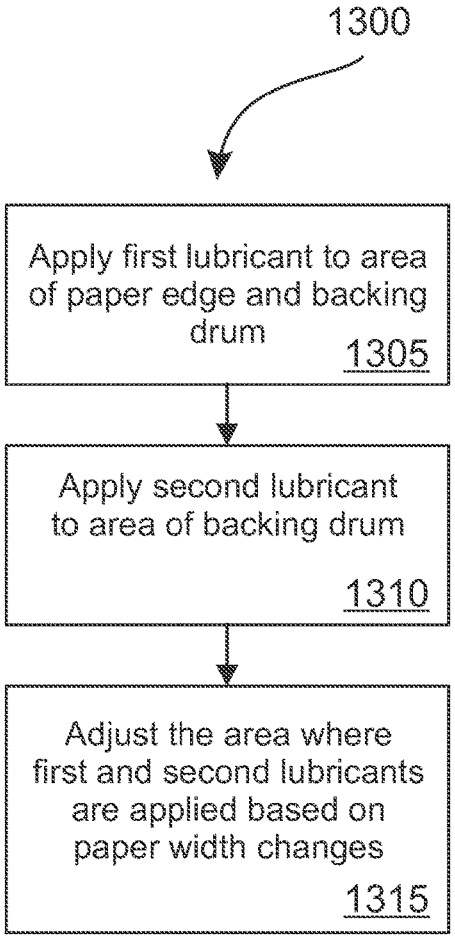
FIG. 13 is a flow diagram illustrating a method of applying multiple lubricant types in accordance with an illustrative embodiment.

FIG. 13 is a flow diagram illustrating a method 1300 of applying multiple lubricant types in accordance with an illustrative embodiment. In alternative embodiments, fewer, additional, and/or different operations may be performed. Also, the use of a flow diagram is not meant to be limiting with respect to the order of operations performed. In an operation 1305, a first lubricant is applied to an area where the paper edge terminates on the backing drum (i.e., the edge region). In an operation 1310, a second lubricant is applied to an area of the backing drum. As disclosed herein, it is advantageous to use different lubrications on these two areas because there are different levels of friction and wear on the coater blade and the backing drum at these two locations.

In an operation 1315, the area where the first and second lubricants are applied is adjusted based on paper width changes. In other words, if the paper width changes, the first lubricant may no longer be applied to the area where the paper terminates on the backing drum. Accordingly, the areas where the first and second lubricants are applied can be adjusted as disclosed herein.

Figure 14:
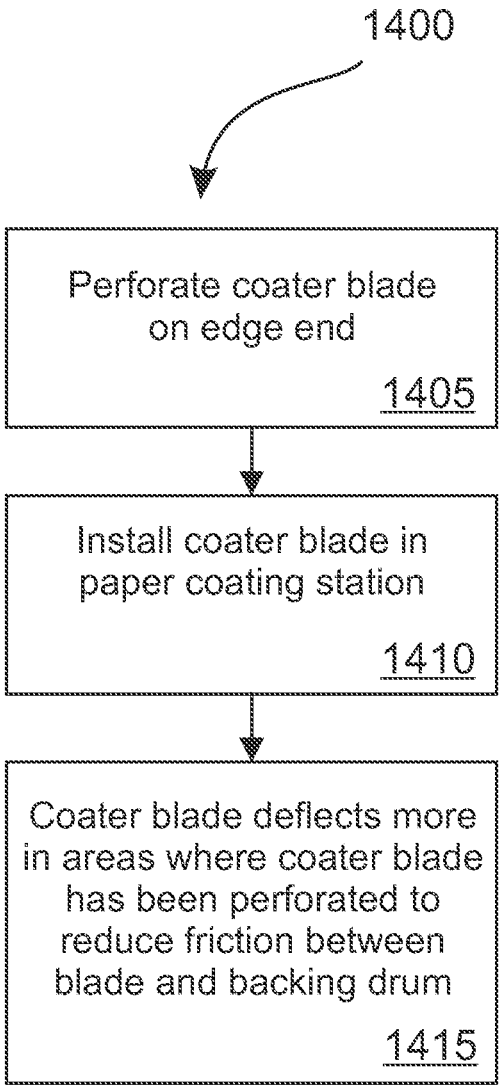
FIG. 14 is a flow diagram illustrating a method of perforating a coater blade in accordance with an illustrative embodiment.

FIG. 14 is a flow diagram illustrating a method 1400 of perforating a coater blade in accordance with an illustrative embodiment. In alternative embodiments, fewer, additional, and/or different operations may be performed. Also, the use of a flow diagram is not meant to be limiting with respect to the order of operations performed. In an operation 1405, a coater blade is perforated on each end where the coater blade would come into contact with a backing drum instead of paper. That is, on the edges of a coater blade where paper will not pass, the coater blade can be perforated. Perforating the coater blade may include punching many holes in the coater blade.

In an operation 1410, the coater blade is installed into a paper coating station. In an operation 1415, the coater blade, during operation of the paper coating machine, deflects more in areas where the coater blade has been perforated, which reduces friction between the blade and the backing drum. In another embodiment, the coater blade may not actually deflect more, but, due to the perforation, the coater blade may exert less pressure or force onto the backing drum. In this way, there may be less friction and wear on the coater blade and the backing drum.

In alternative embodiments, the coater blade may not be perforated. Instead the blade may be thinned, etched, routed, or otherwise weakened or scaled back from its original state. Although not a perforation as described above, such methods may similar weaken a coater blade in strategic locations to reduce the pressure of the coater blade on the backing drum and subsequently reduce friction between the backing drum and the coater blade.

Figure 16:
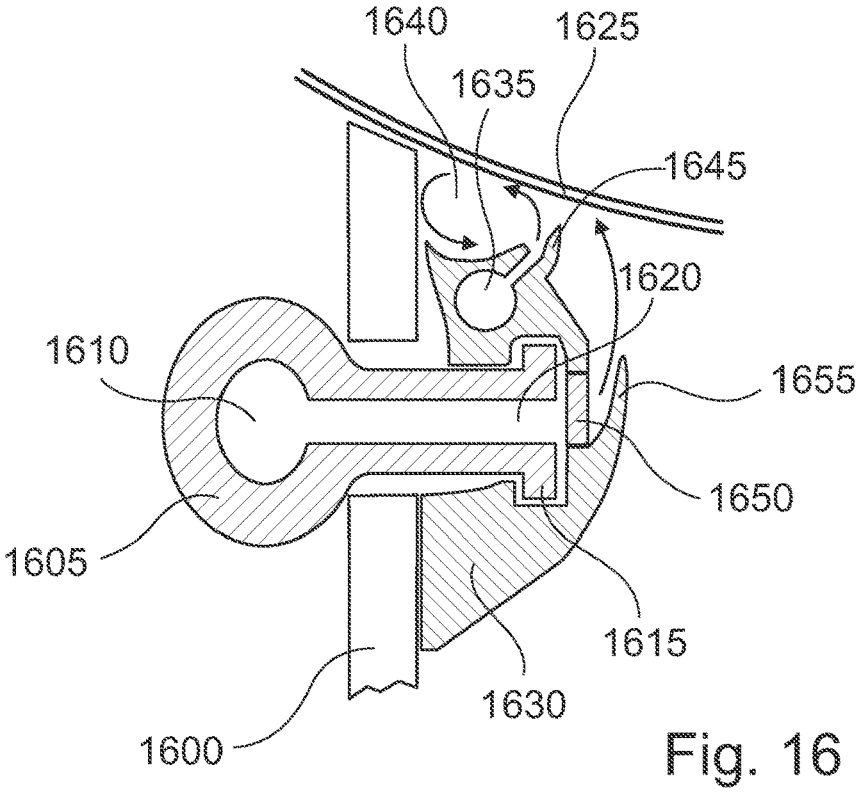
FIG. 16 is a cross-sectional representation of a two part lubricant applicator strip that extends through a coater blade in accordance with an illustrative embodiment.

FIG. 16 is a cross-sectional representation of a two part lubricant applicator strip that extends through a coater blade in accordance with an illustrative embodiment. In alternative embodiments, fewer, additional, and/or different components may be included. A blade 1600 has a perforation in it through which a back part 1605 of the lubricant applicator strip may be inserted. The back part 1605 of the lubricant applicator strip includes a lubricant opening 1610 and a lubricant nozzle 1620. The lubricant nozzle 1620 may extend a significant portion of the length of the back part 1605, or may be small relative to the length of the back part 1605, similar to the nozzles of the FIG. 15.

A front part 1630 of the lubricant applicator strip may include a second lubricant opening 1635 and a lubricant nozzle 1645. The lubricant nozzle 1645 may be variously sized or positioned along the length of the front part 1630. Additionally, for both the lubricant nozzle 1645 and the lubricant nozzle 1620, the nozzles may not (as shown here) be located in the same cross-sectional area. In this way, different lubricants can be sprayed onto different parts of the backing drum, coater blade, and/or paper. For example, the lubricant from the lubricant nozzle 1645 may be directed at the edge of the paper or the edge region on the backing drum.

The lubricant sprayed from the lubricant nozzle 1645 may be directed by an angled portion of the front part 1630 to spray toward paper 1625 in a pressurized cavity 1640. The lubricant sprayed from the lubricant nozzle 1620 may be directed in a direction 1660 toward the paper 1625 by an angled portion 1655 after passing through an opening 1650 in the front part 1630. As demonstrated below, the front part 1630 may be adjusted laterally such that the opening 1650 and or the nozzle 1645 is aimed at different parts of the backing drum, the paper 1625, and/or the coater blade.

Figure 17:
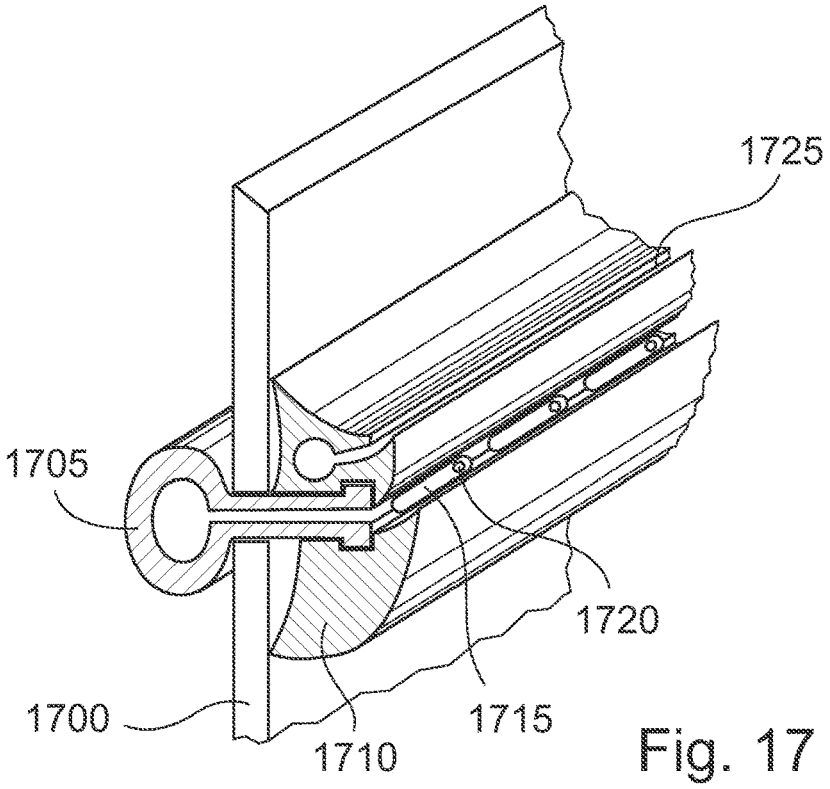
FIG. 17 is a cut-away representation of an adjustable two part lubricant applicator strip that extends through a coater blade in accordance with an illustrative embodiment.

FIG. 17 is a cut-away representation of an adjustable two part lubricant applicator strip that extends through a coater blade in accordance with an illustrative embodiment. In alternative embodiments, fewer, additional, and/or different components may be included. A blade 1700 is perforated, and a back part 1705 and front part 1710 of a lubricant applicator strip are shown in FIG. 17, Here, the first lubricant is sprayed from nozzles, such as nozzle 1720 that is part of the back part 1705. The nozzles in the back part 1705 can fit into openings such as opening 1715 and can be adjusted laterally by moving the back part 1705. Here, the upper lubricant comes out of the opening 1725 and cannot be adjusted. However, in alternative embodiments, the lubricant that comes out of the opening 1725 may be adjusted according to various methods and systems as disclosed herein.

Figure 18:
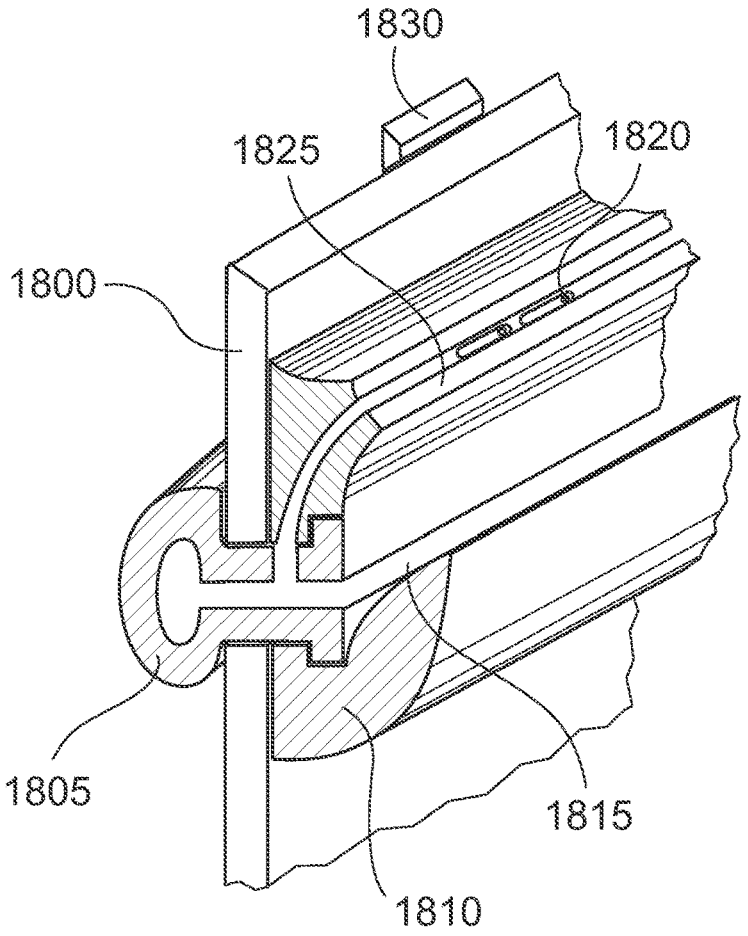
FIG. 18 is a cut-away representation of a two part lubricant applicator strip that extends through a coater blade in accordance with an illustrative embodiment.

FIG. 18 is a out-away representation of a two part lubricant applicator strip that extends through a coater blade in accordance with an illustrative embodiment. In alternative embodiments, fewer, additional, and/or different components may be included. In FIG. 18, a coater blade 1800 has been perforated to fit a back part 1805, which fits with an adjustable front part 1810. Here, the lower lubricant comes out of an opening 1815. The upper lubricant comes out of openings such as opening 1820. When the front part 1810 is moved laterally, the area where lubricant from the opening 1820 is sprayed can be adjusted. An area 1825 is blocked from spraying the upper lubricant. Further, a pointer 1830 is shown. The pointer 1830 is connected to the front part 1810 and passes through (not shown) a perforation in the coater blade 1800. The pointer 1830 is calibrated to align with the openings for the upper lubricant (such as the opening 1820), so that a user adjusting the front part 1820 from the point of view of the back side of the blade (where the opening 1820 may not be visible) can see exactly where the upper lubricant is being sprayed. Further, the front part 1820 may even be adjusted by movement of the pointer 1830.

Figure 19:
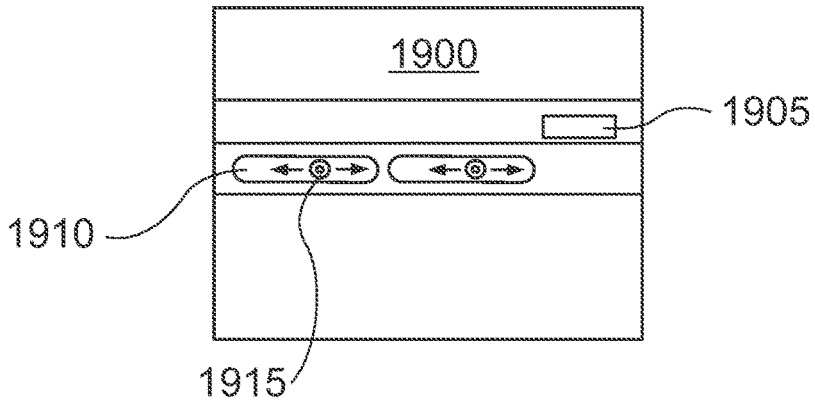
FIG. 19 is a representation of the front of a two part lubricant applicator strip in accordance with an illustrative embodiment.

FIG. 19 is a representation of the front of a two part lubricant applicator strip in accordance with an illustrative embodiment. In alternative embodiments, fewer, additional, and/or different components may be included. FIG. 19 shows a lubricant applicator strip front part 1900. Here the nozzle 1915 may be part of a back part of a two part lubricant applicator. The nozzle 1915, stays stationary as the front part 1900 moves laterally around it. Thus the nozzle 1915 may move freely throughout the opening 1910. In this way, the upper lubricant coming out of the opening 1905 may be freely adjusted (for example to where a paper edge or edge region is) without affected the nozzle spray from the nozzle 1915.

Figure 20:
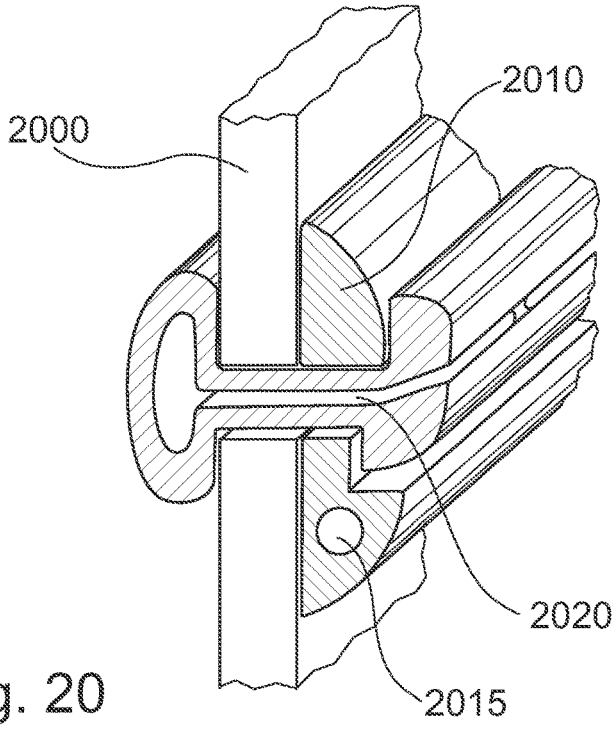
FIG. 20 is a cut-away representation of another two part lubricant applicator strip that extends through a coater blade in accordance with an illustrative embodiment.

FIG. 20 is a cut-away representation of another two part lubricant applicator strip that extends through a coater blade in accordance with an illustrative embodiment. In alternative embodiments, fewer, additional, and/or different components may be included. FIG. 20 shows a coater blade 2000 with a perforation for a back part 2005 and a front part 2010 of a lubricant applicator strip. Here, the upper lubricant comes from the back part 2005 and the lower lubricant comes from the lubricant opening 2015 in the front part 2010. Further, instead of having an angle portion that directs the flow of lubricant from the opening 2020 on the front part 20101, the opening 2020 is actually angled up toward a blade nip. In alternative embodiments, the opening 2020 may be angled more or less than shown in FIG. 20.

Figure 21:
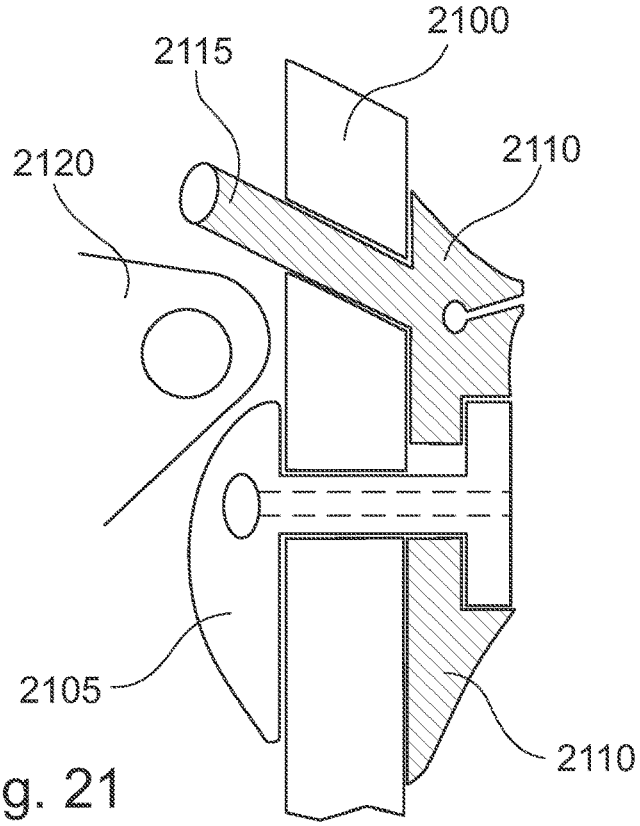
FIG. 21 is a cross-sectional representation of a two part lubricant applicator strip that includes a mechanical pointer in accordance with an illustrative embodiment.

FIG. 21 is a cross-sectional representation of a two part lubricant applicator strip that includes a mechanical pointer in accordance with an illustrative embodiment. In alternative embodiments, fewer, additional, and/or different components may be included. FIG. 21 shows a coater blade 2100 a front part 2110 and a back part 2105 of a lubricant applicator strip. Here, an additional perforation is made for a mechanical pointer 2115 similar to the pointer discussed above with respect to FIG. 18. Furthermore, a securing air tube 2120 is shown. The securing air tube 2120 presses the blade up against the backing drum and the paper. Here, the mechanical pointer 2115 and the perforation it passes through is positioned so as to avoid the securing air tube 2120. Securing air tubes are often a part of a coater machine and utilized to secure a coater blade.

Figure 22:
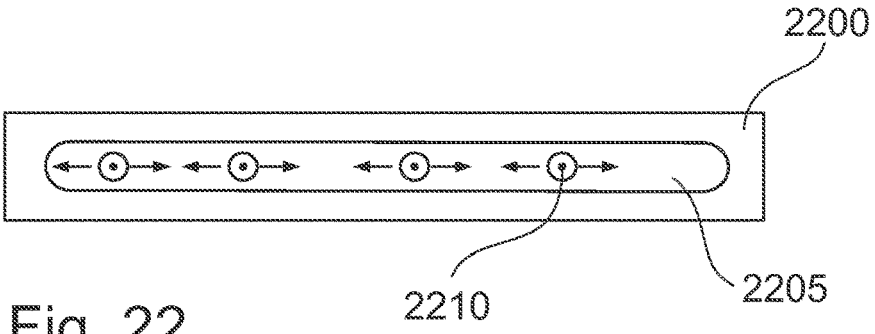
FIG. 22 is a representation of a straight-line adjustable single lubricant nozzle pattern in accordance with an illustrative embodiment.

FIG. 22 is a representation of a straight-line adjustable single lubricant nozzle pattern in accordance with an illustrative embodiment. In alternative embodiments, fewer, additional, and/or different components may be included. Here, a front part 2200 of a lubricant applicator strip is shown. The front part 2200 has an opening 2205 for nozzles, such as nozzles 2210. The front part 2200 is adjustable so that stationary nozzles from the back part of a lubricant applicator strip can move within the opening. In an alternative embodiment, the back part may move within a stationary front part 2200. In a further alternative embodiment, the opening 2205 may instead be closed, but have a lubricant opening behind it, so that nozzles such as the nozzle 2210 may be a piece of the front part 2200. In this embodiment, the lubricant can flow throughout the opening behind 2205 and spray out the nozzles such as the nozzle 2210. If the front part 2200 is adjusted laterally, the nozzles can be adjusted to spray different parts of the backing drum, coater blade, and paper.

Figure 23:
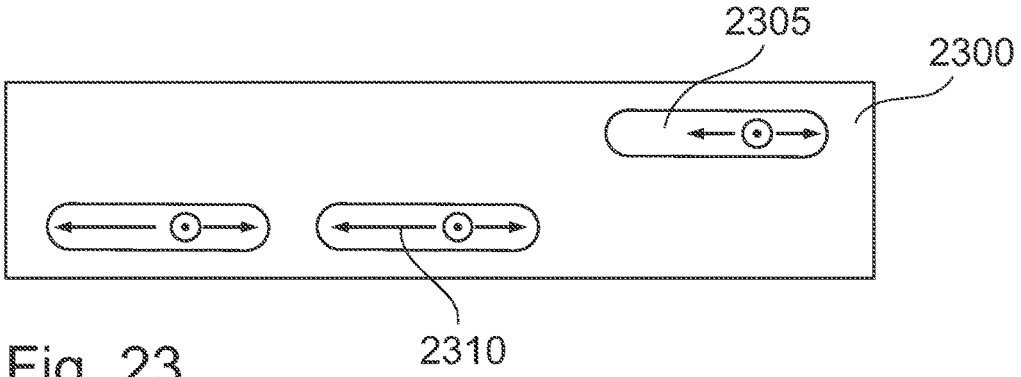
FIG. 23 is a representation of a stepped adjustable double lubricant nozzle pattern in accordance with an illustrative embodiment.

FIG. 23 is a representation of a stepped adjustable double lubricant nozzle pattern in accordance with an illustrative embodiment. In alternative embodiments, fewer, additional, and/or different components may be included. FIG. 23 shows openings 2305 and 2310 in the front part 2300. The upper opening 2305 may include a nozzle for a second lubricant as disclosed herein.

Figure 24:
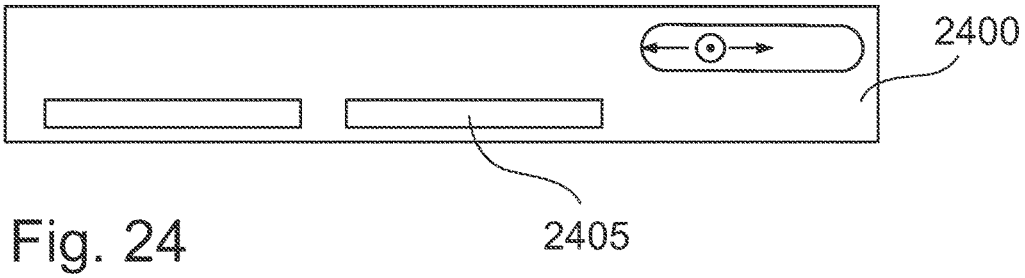
FIG. 24 is a representation of a stepped partially adjustable double lubricant nozzle pattern in accordance with an illustrative embodiment.

FIG. 24 is a representation of a stepped partially adjustable double lubricant nozzle pattern in accordance with an illustrative embodiment. In alternative embodiments, fewer, additional, and/or different components may be included. A front part 2400 may be adjusted to change where lubricant from opening 2405 is sprayed.

Figure 25:
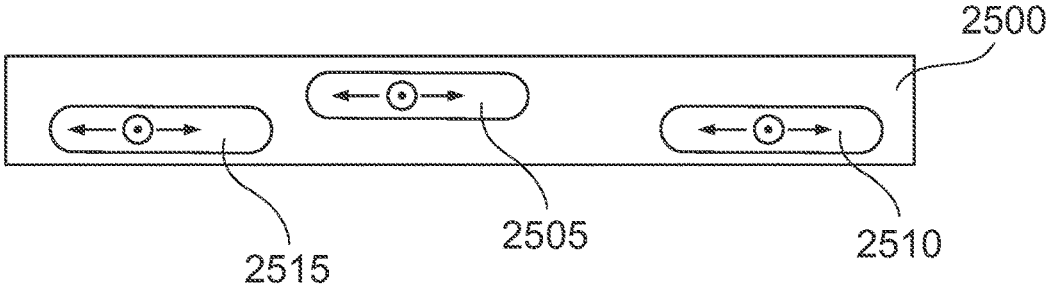
FIG. 25 is a representation of an alternating adjustable double lubricant nozzle pattern in accordance with an illustrative embodiment.

FIG. 25 is a representation of an alternating adjustable double lubricant nozzle pattern in accordance with an illustrative embodiment. In alternative embodiments, fewer, additional, and/or different components may be included.

Figure 26A:
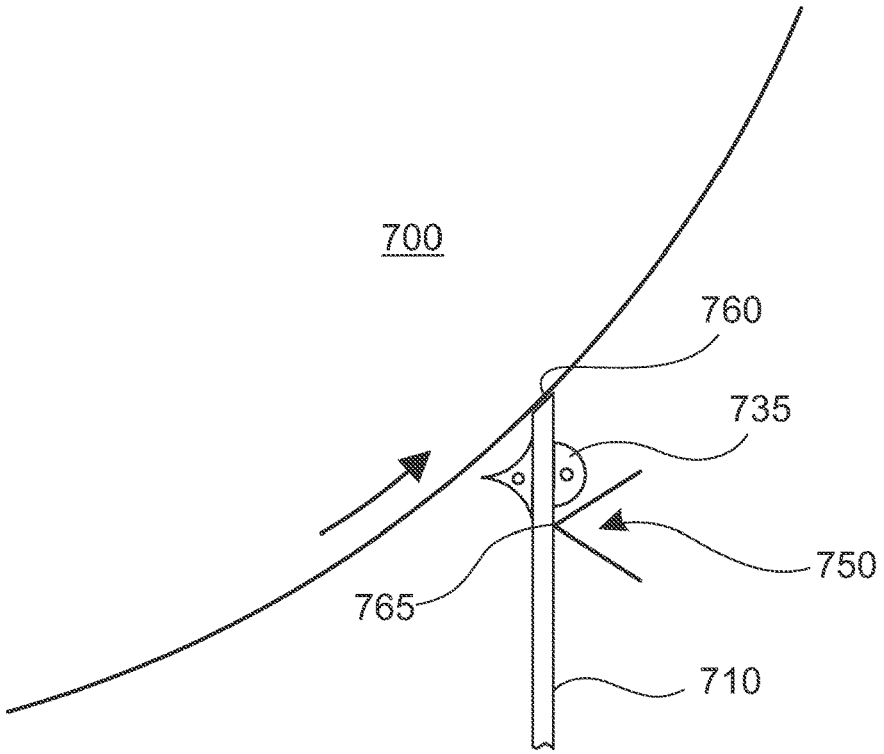
FIGS. 26*a* and 26*b* are presentations of positioning of the lubrication applicator strip on a coater blade in accordance with an illustrative embodiment.
Figure 26B:
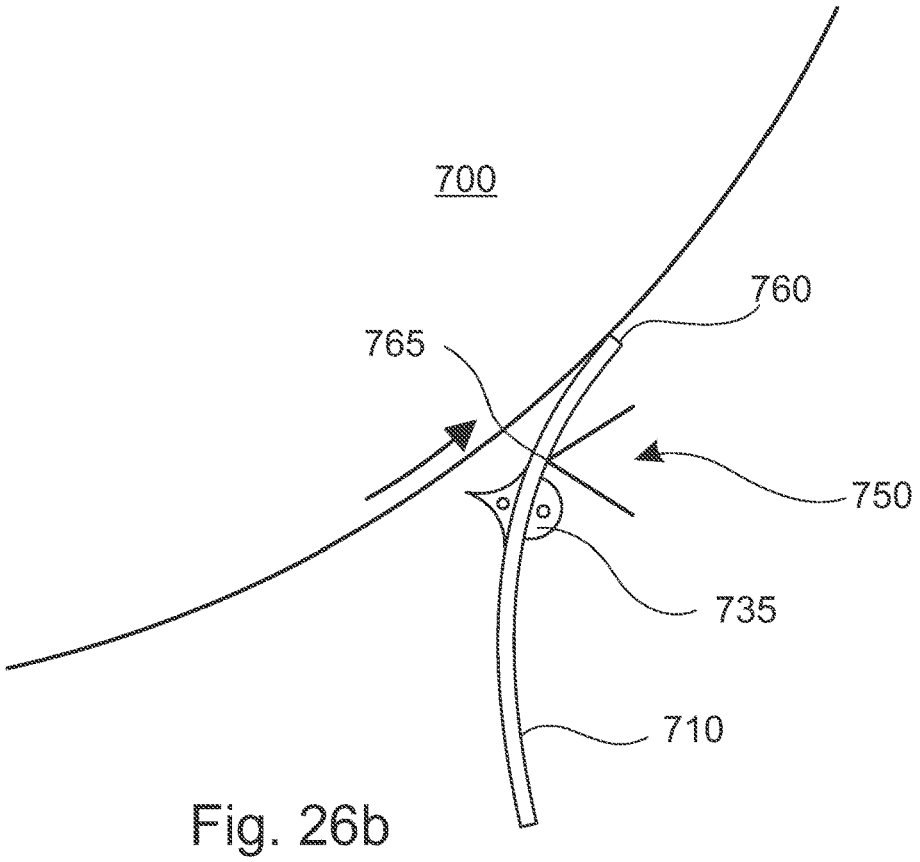

FIG. 26 gives a closer view to the embodiment of FIG. 7 disclosing the use of a lubrication applicator strip 735 of the invention in case of two different operation methods for metering the coating medium on the web. FIG. 26*a* is a very schematic drawing of a stiff blade coating mode which is typically used in high speed coating of paper or board. Angle between the coating blade 710 and the backing drum 700 is typically more than 20 degrees whereas in the bent blade coating mode of FIG. 26*b* the angle between the coater blade 710 and the drum 700 is smaller, typically less than 15 degrees. In both coating modes coat weight is controlled by a loading member or a fulcrum 750, which can be a pneumatic tube or a solid bar and is illustrated schematically by an arrow tip. A fulcrum point 765 is formed on the blade at the contact point of the fulcrum device 750. In principal it is beneficial to locate the lubrication application strip 735 as close as possible to the tip 760 of the coater blade 710 to ensure ideal lubrication between the blade tip 760 and the backing drum 700 but not adversely affecting the coating result. In the stiff blade mode this can be accomplished easily by placing the lubrication applicator strip 735 above the fulcrum 750 or, in other words, between the blade tip 760 and the fulcrum point 765. However, when the space limitations, machine speed, grammage of the web or other factors require operation in smaller blade angle the bent blade coating mode is used. Then the lubrication applicator strip 735 is located farther from the blade tip 760 ic. below the fulcrum point 765 such that the fulcrum point 765 is located between the blade tip 760 and the lubrication applicator strip 735. Although FIGS. 26*a* and 26*b* present a lubrication applicator strip 735 extending through the coater blade 710 in accordance with the embodiments of FIGS. 15-21 it is to be understood that securing the lubrication applicator strip 735 only on one side of the coater blade 710—as for example in the embodiment of FIG. 9—is applicable as well.

Figure 27:
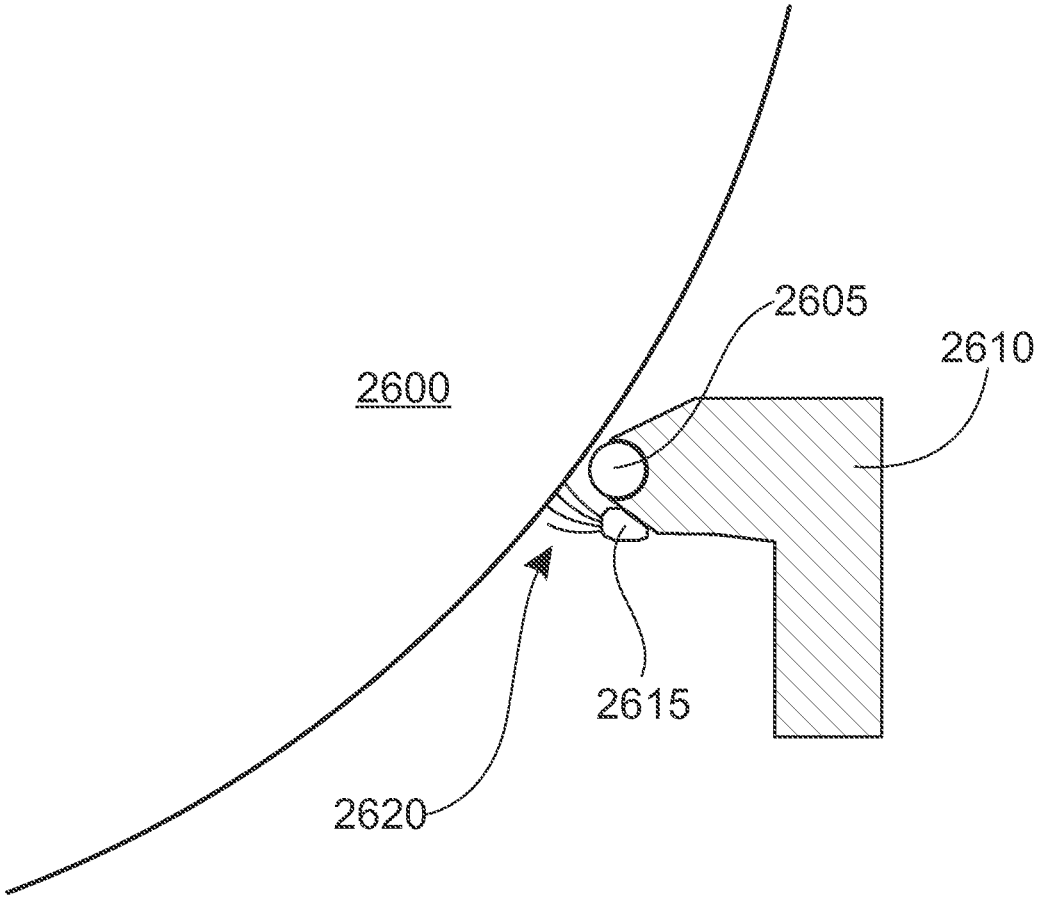
FIG. 27 is a representation of a lubricant applicator strip used with a rod coater in accordance with an illustrative embodiment.

FIG. 27 is a representation of a lubricant applicator strip used with a rod coater in accordance with an illustrative embodiment. In alternative embodiments, fewer, additional, and/or different components may be included. Here, a backing drum 2600 is shown with a rod coater. A rod 2605 may extend the length of the backing drum and function similar to a coater blade. That is, the rod may spread coating and remove excess coating. The rod 2605 is held in place by a rod holder 2610. In some embodiments, the rod holder 2610 may be inserted into a coater machine in the same way a coater blade is inserted into a coater machine. Also similar to a coater blade, a rod may wear and benefit from additional lubrication at the paper edge or edge region and where the backing drum is exposed beyond the paper edge. Accordingly, a lubricant applicator strip 2615 can be applied to a rod coater scenario. The lubricant applicator strip 2615 can spray lubricant 2620 onto the backing drum, rod, and/or paper similar to other embodiments and methods disclosed herein.

is a illustrative embodiment, various methods and systems disclosed herein may be accomplished through use of a controller. For example, a controller may automatically adjust the air pressure of air tubes used in a coating station. A controller may automatically adjust flow levels of lubricant through a lubricant applicator. A controller may also automatically adjust the orientation of a lubricant applicator based on a position of the edge of paper on a backing drum. A variation of controller may include an electronic device, which may include integrated circuits and/or a computing device that controls various electrically controlled valves, pumps, motors, and magnets. Using computer readable instructions, a computing device may provide control signals to components of the systems disclosed herein in order to carry out the functions methods of the various embodiments discussed herein. Such a controller may send electrical signals in order to turn on and off valves, turn on or off various pumps, motors, backing drums, coating stations, etc. or adjust speeds or settings of various pumps, motors, backing drums, coating stations, etc.

In an illustrative embodiment, any of the operations described herein can be implemented at least in part as computer-readable instructions stored on a computer-readable medium or memory. Upon execution of the computer-readable instructions by a processor, the computer-readable instructions can cause a computing device to perform the operations.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A lubricant applicator for applying lubricant to a backing drum, the backing drum having a cylindrical surface defining an axis about which the drum rotates and a coater blade which extends in a direction parallel to the drum axis, the coater blade engaging a paper or board web on the backing drum, the paper or board web having two edges which extend circumferentially about a portion of the cylindrical surface on the backing drum, and the paper or board web is covered with a flowable coating at least as the paper or board web engages the coater blade, the coater blade also engaging a portion of the backing drum surface adjacent to at least one of the two paper or board web edges not covered by the paper or board web, the lubricant applicator comprising:

an applicator body which is elongated in the direction parallel to the drum axis and the applicator body having an outer surface and portions forming a first inner lumen which also extends in the direction parallel to the drum axis;

wherein the applicator body is mounted to the coater blade which is elongated in the direction parallel to the drum axis;

wherein portions of the applicator body defining a plurality of first openings connecting the first lumen to the outer surface of the body;

wherein the first lumen is connected to a first source of lubricating fluid so that lubricating fluid will flow out of the plurality of first openings;

wherein the plurality of first openings connecting the first lumen to the outer surface of the body are arranged at least spaced along the applicator body in the direction parallel to the drum axis and along the coater blade;

wherein the applicator body is positioned on the coater blade so that the plurality of first openings apply lubricating fluid to at least the portion of the backing drum surface adjacent to one of the two paper or board web edges not covered by the paper or board web; and wherein the plurality of first openings apply lubricating fluid to the backing drum so that the coater blade engages the backing roll after lubricating fluid has been applied.

2. The lubricant applicator of claim 1 wherein portions of the applicator body surrounding each of the first plurality of openings, extend away from the applicator body to form nozzles, one about each of the first plurality of openings;

wherein the applicator body is mounted to one side of the coating blade and wherein the nozzles extend through portions of the coating blade forming through holes, to a second side of the coating blade, so the nozzles apply lubricating fluid to the backing drum before the coater blade engages the backing roll.

3. The lubricant applicator of claim 1 wherein the applicator body forming a second inner lumen which also extends in the direction parallel to the drum axis the second lumen defining a second inner surface;

wherein further portions of the applicator body defining a second plurality of openings connecting the second lumen to the outer surface of the body;

wherein the second lumen is connected to a second and different source of lubricating fluid so that the second lubricating fluid will flow out of the second plurality of openings;

wherein the plurality of second openings connecting the lumen to the outer surface of the body are arranged at least spaced along the applicator body in the direction parallel to the drum axis and along the coater blade;

wherein the plurality of second openings are spaced from the plurality of first openings so that every second opening is further in the direction parallel to the drum axis along the coater blade, than the plurality of first openings; and wherein the first and second plurality of openings are arranged to apply lubricating fluid to the backing drum before the coater blade engages the backing roll.

4. The lubricant applicator of claim 1 wherein the plurality of first openings are 0.5 mm to 3.0 mm in diameter.

5. The lubricant applicator of claim 1 wherein any two consecutive openings of the plurality of first openings are separated from each other by 0.5 cm to 1.5 cm.

6. A lubricant applicator, comprising:

a backing drum, the backing drum having a cylindrical surface defining an axis about which the drum rotates;

a coater blade which extends parallel to the drum axis, and engaging a paper or board web on the backing drum cylindrical surface;

wherein the paper or board web has two edges which extend circumferentially about a portion of the cylindrical surface of the backing drum, and the paper or board web is covered with a flowable coating at least as the paper or board web engages the coater blade;

wherein the coater blade also engaging a portion of the backing drum surface adjacent to at least one of the two paper or board web edges;

an applicator body mounted to the coater blade, wherein the applicator body is elongated in the direction parallel to the drum axis;

wherein the applicator body has an outer surface and portions forming a first inner lumen which also extends in the direction parallel to the drum axis;

wherein portions of the applicator body defining a plurality of first openings connecting the first lumen to the outer surface of the body;

wherein the first lumen is connected to a source first of lubricating fluid so that lubricating fluid will flow out of the plurality of first openings;

wherein the plurality of first openings connecting the first lumen to the outer surface of the body are arranged at least spaced along the applicator body in the direction parallel to the drum axis and along the coater blade;

wherein the applicator body is positioned on the coater blade so that the plurality of first openings apply lubricating fluid to at least the portion of the backing drum surface adjacent one of the two paper or board web edges not covered by the paper or board web; and wherein the plurality of first openings apply lubricating fluid to the backing drum so that the coater blade engages the backing roll after lubricating fluid has been applied.

7. The lubricant applicator of claim 6 wherein portions of the applicator body surrounding each of the first plurality of openings, extend away from the applicator body to form nozzles, one about each of the first plurality of openings;

wherein the applicator body is mounted to a first side of the coating blade and wherein the nozzles extend through portions of the coating blade forming through holes, to a second side of the coating blade, so the nozzles apply lubricating fluid to the backing drum before the coater blade engages the backing roll.

8. The lubricant applicator of claim 6 wherein the applicator body forming a second inner lumen which also extends in the direction parallel to the drum axis;

wherein further portions of the applicator body defining a second plurality of openings connecting the second lumen to the outer surface of the body;

wherein the second lumen is connected to a second and different source of lubricating fluid so that the second lubricating fluid will flow out of the second plurality of openings;

wherein the plurality of second openings connecting the second lumens to the outer surface of the body are arranged at least spaced along the applicator body in the direction parallel to the drum axis and along the coater blade;

wherein the plurality of second openings are spaced from the plurality of first openings so that every second opening is further in the direction parallel to the drum axis and along the coater blade, than the plurality of first openings; and wherein the first and second plurality of openings are arranged to apply lubricating fluid to the backing drum before the coater blade engages the backing roll.

9. A method for lubricating, in a paper or board web coater, between a coating blade and a backing drum, comprising the steps of:

coating a web on a cylindrical surface of the backing drum, while rotating the backing drum about an axis of the cylindrical surface;

engaging the web and the coating thereon with a coating blade such that at least one of spreading the coating on the web and removing excess coating on the web is performed;

wherein the coating blade has a backing drum engaging side, and wherein the web has two edges which extend circumferentially about a portion of the cylindrical surface, and wherein the coater blade also engaging a portion of the backing drum surface adjacent the two web edges that are not covered by the web;

supplying a first lubricant from a first plurality of openings formed in an applicator body mounted to the coating blade, so that the first lubricant is supplied between the cylindrical surface of the backing drum and the coating blade at a plurality of positions which extend along the coater blade at least parallel to the axis of the cylindrical surface, and adjacent to the two web edges.

10. The method of claim 9 wherein the first lubricant is supplied between the cylindrical surface of the backing drum and the coating blade at a pressure sufficient to prevent the coating blade from contacting the cylindrical surface of the backing drum.

11. The method of claim 9 wherein the applicator body is mounted to a side of the coater blade which is opposite the backing drum engaging side and the first lubricant is supplied through portions of the coater blade forming holes and between the engaging side of the coater blade and the cylindrical surface of the backing drum.

12. The method of claim 9 wherein the first lubricant and a second and different lubricant is supplied between the cylindrical surface of the backing drum and the coating blade so that the first lubricant and the second lubricant are supplied one after the other along the coater blade.

13. The method of claim 9 further comprising collecting the first lubricant in a lubricant collector after the first lubricant has been applied between the coater blade and the backing drum and sending the lubricant from the lubricant collector to the lubricant applicator body so the lubricant is reused.

* * * * *